US012742556B2

(12) United States Patent
Chuang et al.

(10) Patent No.: US 12,742,556 B2
(45) Date of Patent: Sep. 22, 2026

(54) HOUSING POSITIONING STRUCTURE FOR VENTILATION FAN

(71) Applicant: DELTA ELECTRONICS, INC., Taoyuan City (TW)

(72) Inventors: Ying-Huang Chuang, Taoyuan City (TW); Chun-Wei Chen, Taoyuan City (TW)

(73) Assignee: DELTA ELECTRONICS, INC., Taoyuan City (TW)

( * ) Notice: Subject to any disclaimer, the term of this patent is extended or adjusted under 35 U.S.C. 154(b) by 170 days.

(21) Appl. No.: 18/734,430

(22) Filed: Jun. 5, 2024

(65) Prior Publication Data

US 2024/0410597 A1 Dec. 12, 2024

Related U.S. Application Data

(60) Provisional application No. 63/471,360, filed on Jun. 6, 2023.

(51) Int. Cl.
*F24F 1/0018* (2019.01)
*F04D 29/60* (2006.01)

(52) U.S. Cl.
CPC ..... *F24F 1/0018* (2013.01); *F04D 29/601* (2013.01)

(58) Field of Classification Search
CPC ..... F24F 1/0018; F04D 29/601
See application file for complete search history.

(56) References Cited

U.S. PATENT DOCUMENTS

| | | | | |
|---|---|---|---|---|
| 8,876,582 | B2 * | 11/2014 | Gao | F24F 7/007 454/341 |
| 8,961,126 | B1 | 2/2015 | Tom | |
| 9,222,266 | B1 | 12/2015 | Conboy | |
| 9,416,989 | B1 * | 8/2016 | Tom | F24F 7/065 |
| D853,552 | S * | 7/2019 | Branham | D23/371 |
| D854,142 | S | 7/2019 | Branham | |
| 10,502,447 | B2 | 12/2019 | Branham | |
| 10,907,843 | B2 | 2/2021 | Penlesky et al. | |
| 11,015,822 | B2 * | 5/2021 | Branham | F24F 13/20 |
| 11,280,515 | B2 | 3/2022 | Branham | |
| 2005/0111972 | A1 * | 5/2005 | Penlesky | F04D 29/626 415/206 |
| 2008/0318515 | A1 * | 12/2008 | Yeung | F04D 29/626 454/343 |
| 2013/0026334 | A1 * | 1/2013 | Long | F24F 13/32 248/675 |

(Continued)

*Primary Examiner* — Terrell L Mckinnon
*Assistant Examiner* — Ding Y Tan
(74) *Attorney, Agent, or Firm* — HDLS IPR SERVICES; Chun-Ming Shih

(57) ABSTRACT

A housing positioning structure includes a housing, an upper supporting structure and a lower supporting structure. The housing includes a top plate and side plates vertically arranged on sides of the top plate. An accommodation space is enclosed by the top plate and the side plates. A horizontal line is formed at the lower edge of the side plate. The direction above and away the horizontal line is defined as an above-body direction, and the direction below and away the horizontal line is defined as a below-body direction. The upper supporting structure is located on the above-body direction side. The lower supporting structure is disposed on the side plates and extends toward the below-body direction side.

18 Claims, 23 Drawing Sheets

(56) References Cited

U.S. PATENT DOCUMENTS

| | | | | |
|---|---|---|---|---|
| 2013/0130612 | A1* | 5/2013 | Penlesky | F24F 7/06 29/428 |
| 2015/0060638 | A1* | 3/2015 | Hu | F24F 13/20 248/674 |
| 2019/0032953 | A1* | 1/2019 | Branham | F24F 13/0236 |
| 2019/0113221 | A1* | 4/2019 | Huang | F24F 7/065 |
| 2019/0360501 | A1* | 11/2019 | Karst | F04D 25/08 |
| 2019/0376522 | A1* | 12/2019 | Liu | F04D 29/422 |
| 2020/0158122 | A1* | 5/2020 | Huang | F21S 8/026 |
| 2020/0217552 | A1* | 7/2020 | Branham | F24F 7/007 |
| 2021/0199319 | A1* | 7/2021 | Branham | F04D 29/4226 |
| 2021/0355949 | A1* | 11/2021 | Chuang | F24F 13/078 |
| 2022/0212522 | A1* | 7/2022 | Skipton | B60H 1/00364 |
| 2023/0012260 | A1* | 1/2023 | Servies | F04D 29/601 |

* cited by examiner

HOUSING POSITIONING STRUCTURE FOR VENTILATION FAN

CROSS-REFERENCE TO RELATED APPLICATION

This patent application claims the benefit of U.S. Provisional Patent Application No. 63/471,360, filed Jun. 6, 2023, which is incorporated by reference herein.

BACKGROUND OF THE DISCLOSURE

Technical Field

The technical field relates to a positioning structure, and more particularly relates to a housing positioning structure for a ventilation fan.

Description of Related Art

A ventilation fan is often installed in an indoor environment to circulate indoor air. Additionally, the ventilation fan is generally installed in the ceiling to improve indoor air quality without occupying indoor space.

Moreover, in the existing ventilation fan, brackets are first combined with the housing of the ventilation fan, and then the housing is installed in the internal space of the ceiling. However, since the brackets require the use of a hand tool to secure multiple screws to the housing, the installation process is complicated and inconvenient. Furthermore, as ceilings in different areas may have different thicknesses, detailed planning is required before installation to ensure that the housing is securely installed and positioned, which is inconvenience during installation.

In view of the above drawbacks, the inventor proposes this disclosure based on his expert knowledge and elaborate researches in order to solve the problems of related art.

SUMMARY OF THE DISCLOSURE

This disclosure is a housing positioning structure designed to position a housing of a ventilation fan in an installation opening of a board.

This disclosure is a housing positioning structure for a ventilation fan including a housing, an upper supporting structure, and a lower supporting structure. The housing includes a top plate and a plurality of side plates vertically arranged on the periphery of the top plate. An accommodation space is enclosed by the top plate and the side plates. A horizontal line is formed at the lower edge of the side plate. The direction above and away the horizontal line is defined as an above-body direction. The direction below and away the horizontal line is defined as a below-body direction. The upper supporting structure is disposed on the housing and located on the above-body direction side. The lower supporting structure is disposed on the lower edge of the side plates and extends toward the below-body direction side.

In one embodiment, the upper supporting structure includes a plurality of brackets and a plurality of fixing parts arranged in pairs, a first through groove is defined on each fixing part, and each of the brackets is inserted in the first through groove.

In one embodiment, each of the fixing parts is a hook. The fixing part includes a supporting plate and a claw portion connected to the supporting plate. The supporting plate extends vertically from a wall of the housing in the direction away from the interior (i.e., the accommodation space) of the housing, and the first through groove is defined on the claw portion.

In one embodiment, each of the fixing parts includes a second through groove, and bottoms of the first through groove and the second through groove are located at different height positions relative to the supporting plate.

In one embodiment, each of the fixing parts includes an L-shaped piece.

In one embodiment, each of the fixing parts includes a supporting piece extending vertically and outwardly from the wall of the housing and a blocking piece bending and extending from the supporting piece.

In one embodiment, the upper supporting structure includes a plurality of bendable wing plates, and the wing plates are arranged in pairs on two sides of the housing opposite to each other.

In one embodiment, the wing plates includes a plurality of first wing plates and a plurality of second wing plates. The first wing plates and the second wing plates are located on the bottom side of the housing and have different heights relative to the horizontal line after being bent.

In one embodiment, the first wing plate includes a first extension piece and a first bending piece. The first extension piece is attached to the wall of the housing. The first bending piece is connected to the first extension piece, being bendable outwardly in the direction away from the housing to attach the board.

In one embodiment, the first wing plate includes a first return fold bending from one end of the first bending piece.

In one embodiment, a plurality of first bending holes is arranged spacedly on each of the first wing plates and located between the first extension piece and the first bending piece.

In one embodiment, the upper supporting structure includes a plurality of bending plates arranged in pairs on two sides of the housing opposite to each other.

In one embodiment, the bending plates includes a plurality of first bending plates and a plurality of second bending plates. The first bending plates and the second bending plates are located on the bottom side of the housing and have different heights relative to the horizontal line after being bent.

In one embodiment, the first bending plate includes a first fixed edge and a first folding edge. The first fixed edge is connected to the wall of the housing, and the first folding edge is bent outwardly in the direction away from the interior (i.e., the accommodation space) of the housing to attach the board.

In one embodiment, the first bending plate includes a first fixed edge and a first folding edge. The first fixed edge is connected to the wall of the housing, and the first folding edge is bent outwardly in a direction away from the accommodation space.

In one embodiment, the first bending plate further includes a groove surrounding the first bending plate and a plurality of bending holes arranged spacedly on the first fixed edge.

In one embodiment, the upper supporting structure includes a plurality of flip plates attached to two sides of the housing opposite to each other. The upper supporting structure rotates horizontally from the surface of the housing in the direction away from the interior (i.e., the accommodation space) of the housing.

In one embodiment, the flip plates include a plurality of first flip plates and a plurality of second flip plates. The first flip plates and the second flip plates are located on the bottom side of the housing and have different heights relative to the board (i.e., the bottom plate) after rotation.

In one embodiment, the first flip plate includes a first fixed edge and a first folding edge. The first fixed edge is connected to the wall of the housing, and the first folding edge rotates outwardly in the direction away from the interior (i.e., the accommodation space) of the housing to attach the board.

In one embodiment, a plurality of first bending holes is defined on the first fixed edge and located on one side connected to the wall of the housing.

In one embodiment, the lower supporting structure includes a bending arm and a clamping piece. The bending arm is foldable outwardly in a direction away from the interior of the housing.

In one embodiment, the bending arm includes a first bending edge and a second bending edge. A plurality of bending holes is defined on the first bending edge and the second bending edge.

In one embodiment, the clamping piece is an L shape and includes a second bending section and a third bending section. The second bending section is connected to the bending arm, and the third bending section bends and extends from the second bending section in the direction away from the interior of the housing.

In one embodiment, a fixing hole is defined on the third bending section.

In one embodiment, a plurality of bending slots is disposed at the connection portion between the second bending section and the third bending section.

In one embodiment, each bending slot is an L shape.

Compared with the related art, the housing positioning structure in this disclosure has an upper supporting structure and a lower supporting structure disposed on the housing. Additionally, an installation opening is defined on the board, and an installation space is defined between the board and the wall. An above-board (or above-body) direction and a below-board (or below-body) direction are defined on two sides of the installation opening, respectively. Furthermore, the part of the housing located on the below-board direction is supported and positioned by the upper supporting structure. The lower supporting structure extends toward the below-board direction side, thereby restricting the housing from below. Accordingly, the housing is supported and positioned by both the upper and the lower supporting structures to be combined in the installation opening. Additionally, the upper and lower supporting structures of this disclosure have various embodiments for users to choose from according to their needs and may be applied to boards of different thicknesses. Therefore, the housing is positioned in the installation opening of the board through a simple upper and lower supporting structures, thereby increasing the convenience and practicality of installation.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
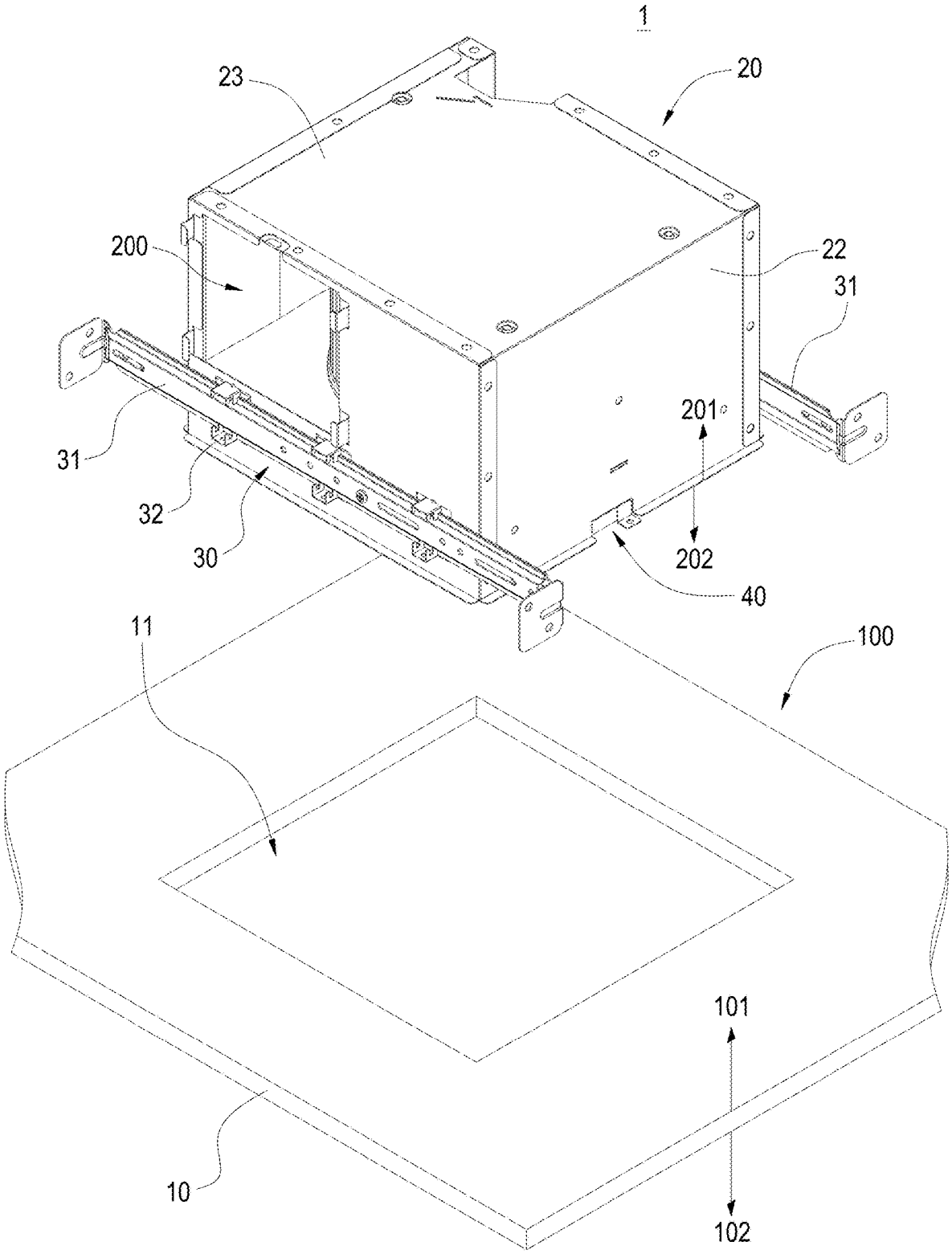
FIG. 1 illustrates an installation schematic view of the housing positioning structure for a ventilation fan in this disclosure.
Figure 2:
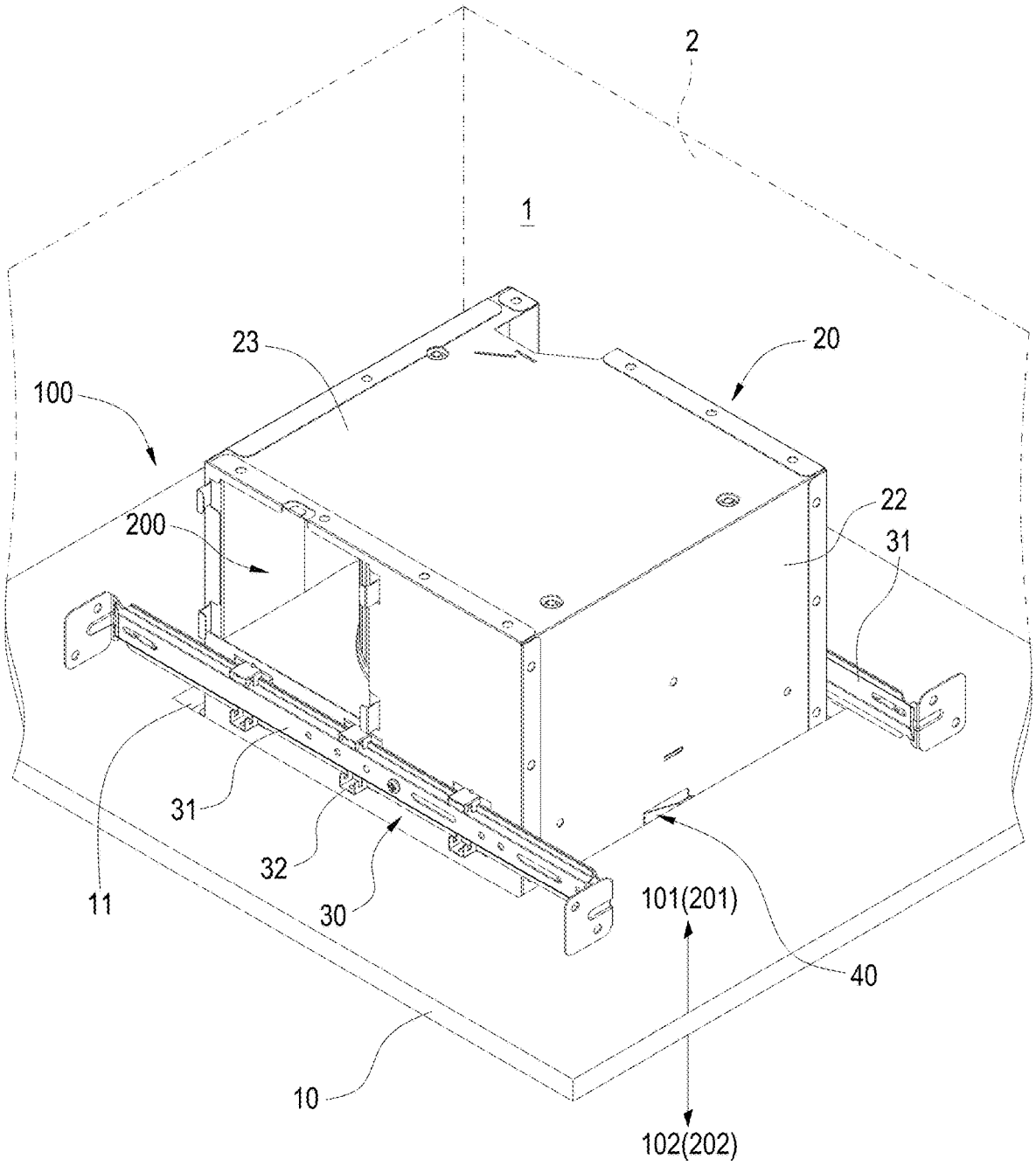
FIG. 2 illustrates a schematic view from one side of the housing positioning structure for a ventilation fan after installation in this disclosure.

Please refer to FIG. 1 and FIG. 2, which depict an installation schematic view of the housing positioning structure for a ventilation fan in this disclosure and a schematic view from one side of the housing positioning structure for a ventilation fan after installation in this disclosure. A housing positioning structure 1 includes a housing 20, an upper supporting structure 30 and a lower supporting structure 40. The housing 20 includes a top plate 23 and a plurality of side plates 22 vertically arranged on the periphery of the top plate 23. An accommodation space 200 is enclosed by the top plate 23 and the side plates 22. A horizontal line is formed at the lower edge of the side plate 22. The direction above and away the horizontal line is defined as the above-body direction side 201. The direction below and away the horizontal line is defined as the below-body direction side 202.

In this embodiment, the housing positioning structure 1 further includes a board 10. The board 10 may be a bathroom ceiling made of gypsum or calcium silicate. Moreover, the board 10 is fixed on one side of the wall 2. An installation opening 11 is defined on the board 10, and an installation space 100 is defined by the board 10 and the wall 2. In an embodiment in which the housing positioning structure 1 includes a board 10, the side of the installation opening 11 facing the installation space 100 is defined as the above-board direction side 101, and the opposite side is defined as the below-board direction side 102.

The upper supporting structure 30 is disposed on the housing 20 and located on the above-body direction side 201. The lower supporting structure is disposed on the vertical surface (i.e., the side plate 22) of the housing 20 adjacent to the horizontal line and extends toward the below-board direction side 102 (i.e., below-body direction side 202). In this embodiment, the lower supporting structure 40 is disposed on the side of the housing 20 adjacent to the board 10. The lower supporting structure 40 extends toward the below-board direction side 102 and is attached to the board 10. The upper supporting structure 30 and the lower supporting structure 40 are arranged outside the housing 20 to support and clamp the housing 20. Thus, the housing 20 is positioned on the board 10.

Specifically, the upper supporting structure 30 includes a plurality of brackets 31 and a plurality of fixing parts 32 arranged in pairs. In this embodiment, the bracket 31 inserts the fixing part 32 in the installation space 100. The housing 20 is combined on the installation opening 11 through the upper supporting structure 30 and the lower supporting structure 40.

In more detail, the upper supporting structure 30 is located on the above-board direction side 101 (i.e., the above-body direction side 201) to be disposed on opposite sides of the housing 20. The upper supporting structure 30 includes a plurality of brackets 31 and a plurality of fixing parts 32 arranged in pairs. The brackets 31 are inserted in the fixing parts 32 and are fixed in the installation space 100, such as the wall 2 and other fixed objects. The part of the housing 20 located on the above-board direction side 101 is supported and positioned by the upper supporting structure 30. Additionally, the lower supporting structure 40 is disposed on the side of the housing 20 adjacent to the board 10.

Figure 3:
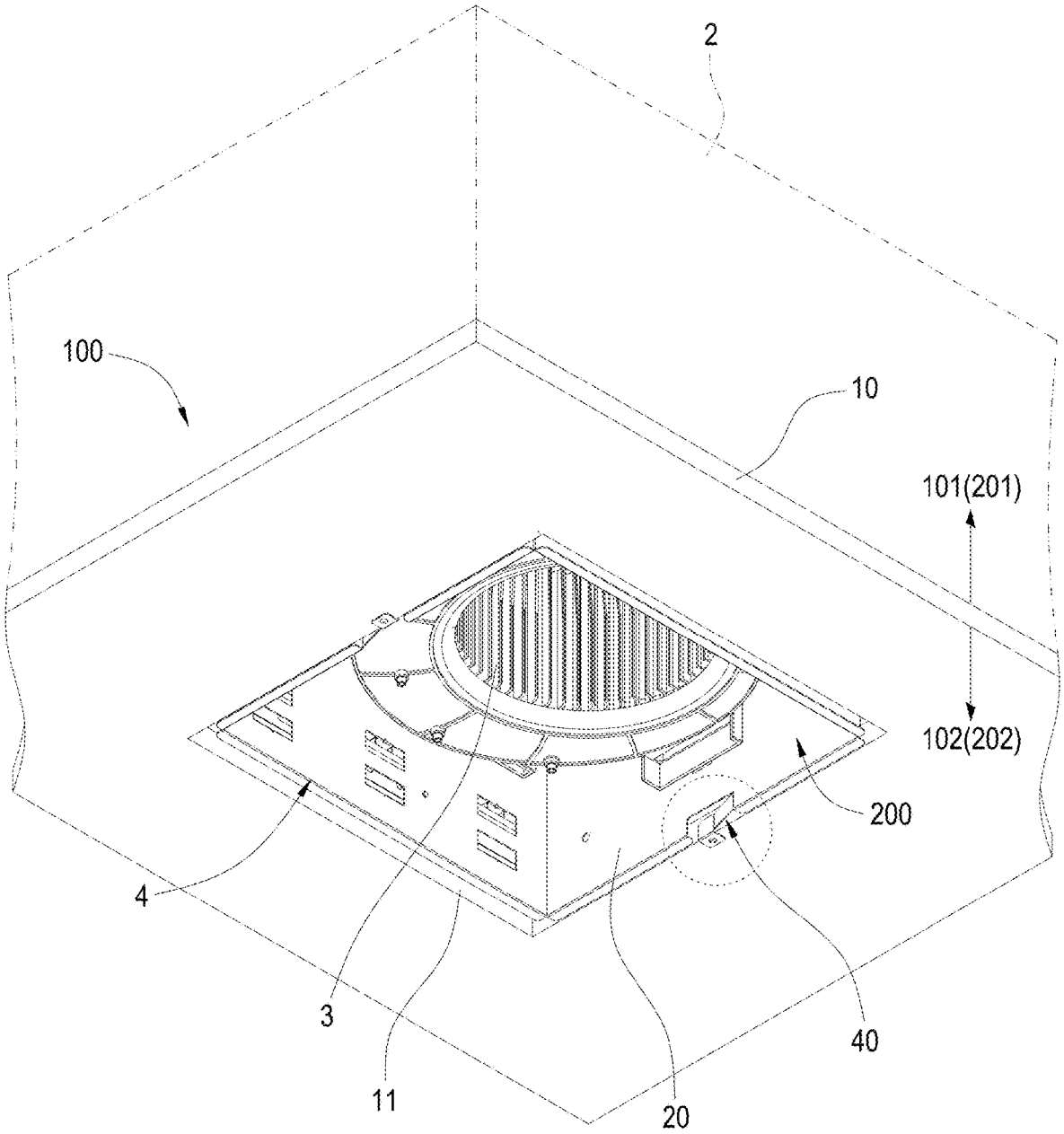
FIG. 3 illustrates a schematic view from another side of the housing positioning structure for a ventilation fan after installation in this disclosure.

Please further refer to FIG. 3, which depicts a schematic view from another side of the housing positioning structure for a ventilation fan after installation in this disclosure. As show in FIG. 3, the housing 20 is a metal shell of a ventilation fan 3. The ventilation fan 3 is installed in the housing 20, and an air inlet 4 is defined at the installation opening 11. The lower supporting structure 40 is disposed on the bottom side of the housing 20 and extends to the below-board direction side 102. The lower supporting structure 40 extends toward the below-board direction side 102 and attaches to the board 10 to restrict the housing 20 from below. Accordingly, the ventilation fan 3 and the housing 20 are supported and positioned by the upper supporting structure 30 and the lower supporting structure 40 to be combined in the installation opening 11.

Figure 4:
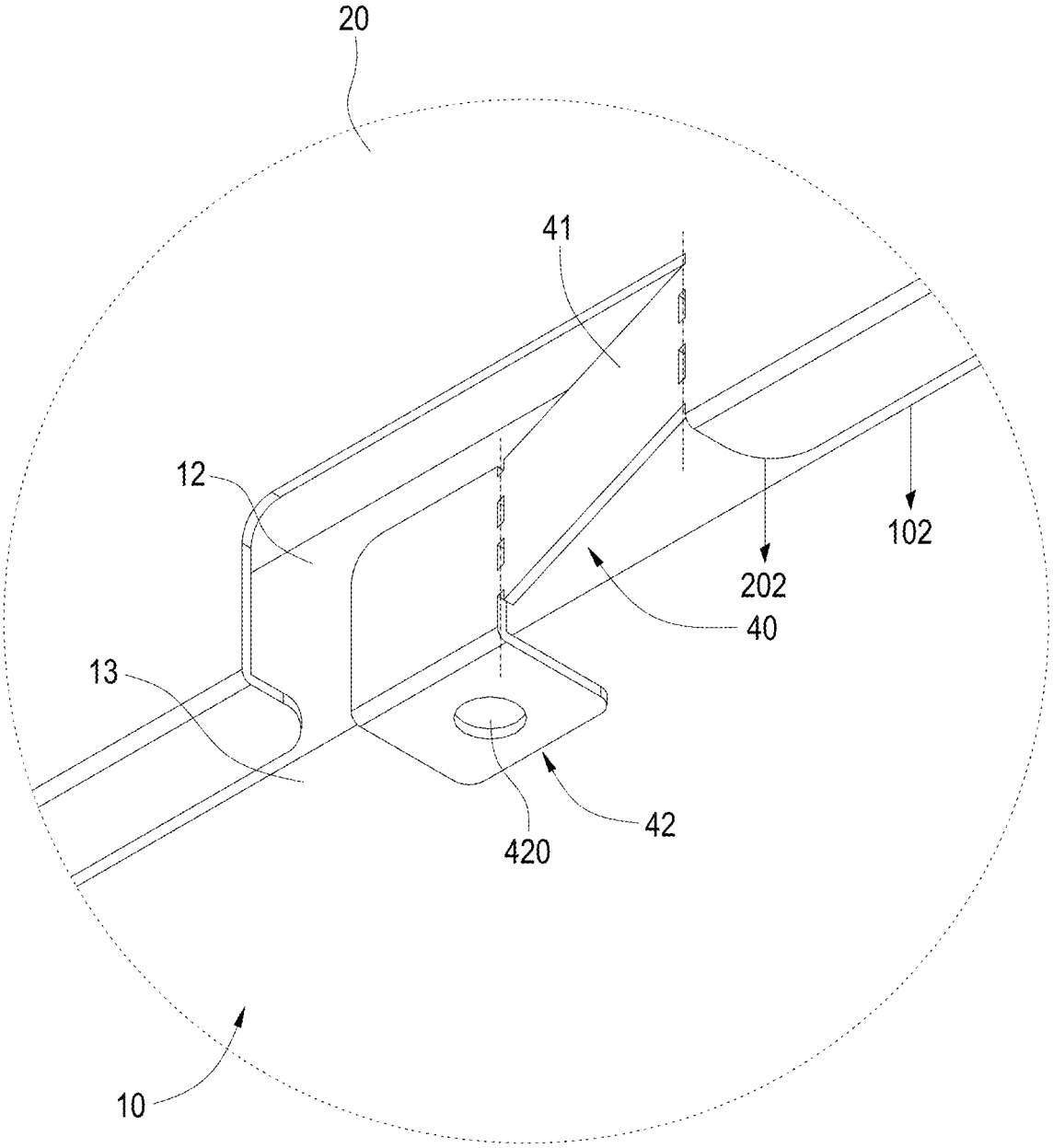
FIG. 4 illustrates an enlarged schematic view of the first embodiment of the lower supporting structure after installation in this disclosure.

Please refer to FIG. 4, which depicts an enlarged schematic view of the first embodiment of the lower supporting structure after installation in this disclosure. In this embodiment, the lower supporting structure 40 includes a bending arm 41 and a clamping piece 42. The bending arm 41 is foldable outwardly in the direction away from the interior of the housing 20 to make the clamping piece 42 to attach to two sides of the board 10, that is the board thickness surface 12 of the board 10 and the board surface 13 facing the below-board direction side 102. It should be noted that the clamping piece 42 may include a spare fixing hole 420 for inserting additional fasteners.

Figure 5:
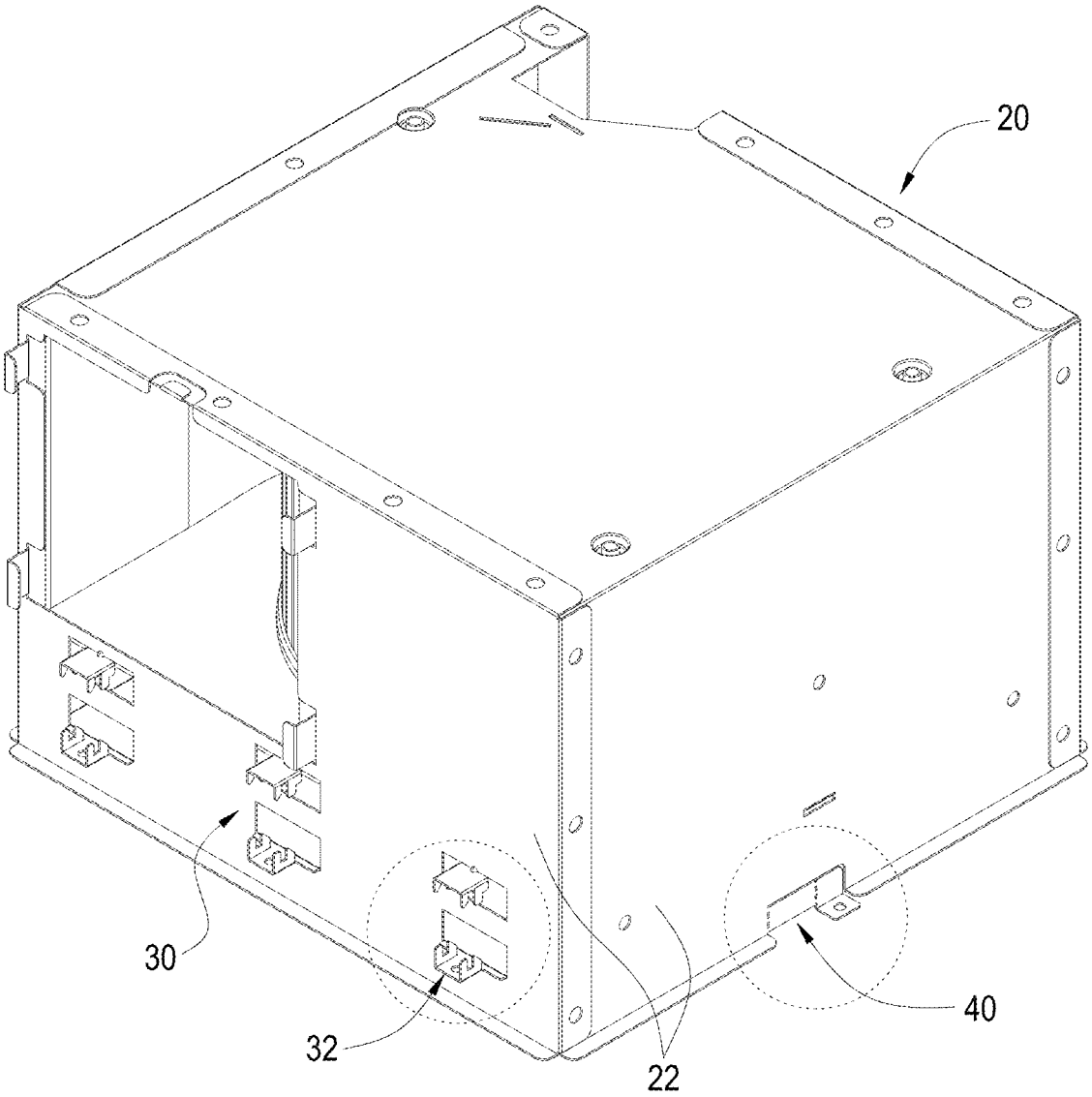
FIG. 5 illustrates a schematic view of the arrangement of the first embodiment of the upper supporting structure and the first embodiment of the lower supporting structure in this disclosure.

Please refer to FIG. 5, which depict a schematic view of the arrangement of the first embodiment of the upper supporting structure and the first embodiment of the lower supporting structure in this disclosure. In this embodiment, the housing 20 is a rectangular cuboid. The upper supporting structure 30 is disposed on two sides of the housing 20 opposite to each other. The lower supporting structure 40 is disposed on another two sides of the housing 20 opposite to each other. The upper supporting structure 30 and the lower supporting structure 40 are located on different side plates 22 of the housing 20. However, the upper supporting structure 30 and the lower supporting structure 40 may also be located on the same side of the housing 20, but this is not limited thereto.

Further, the upper supporting structure 30 includes a plurality of fixing parts 32 arranged in pairs and spacedly. Additionally, in the first embodiment of the upper supporting structure 30 in this disclosure, the fixing part 32 is structured as a hook.

Figure 6:
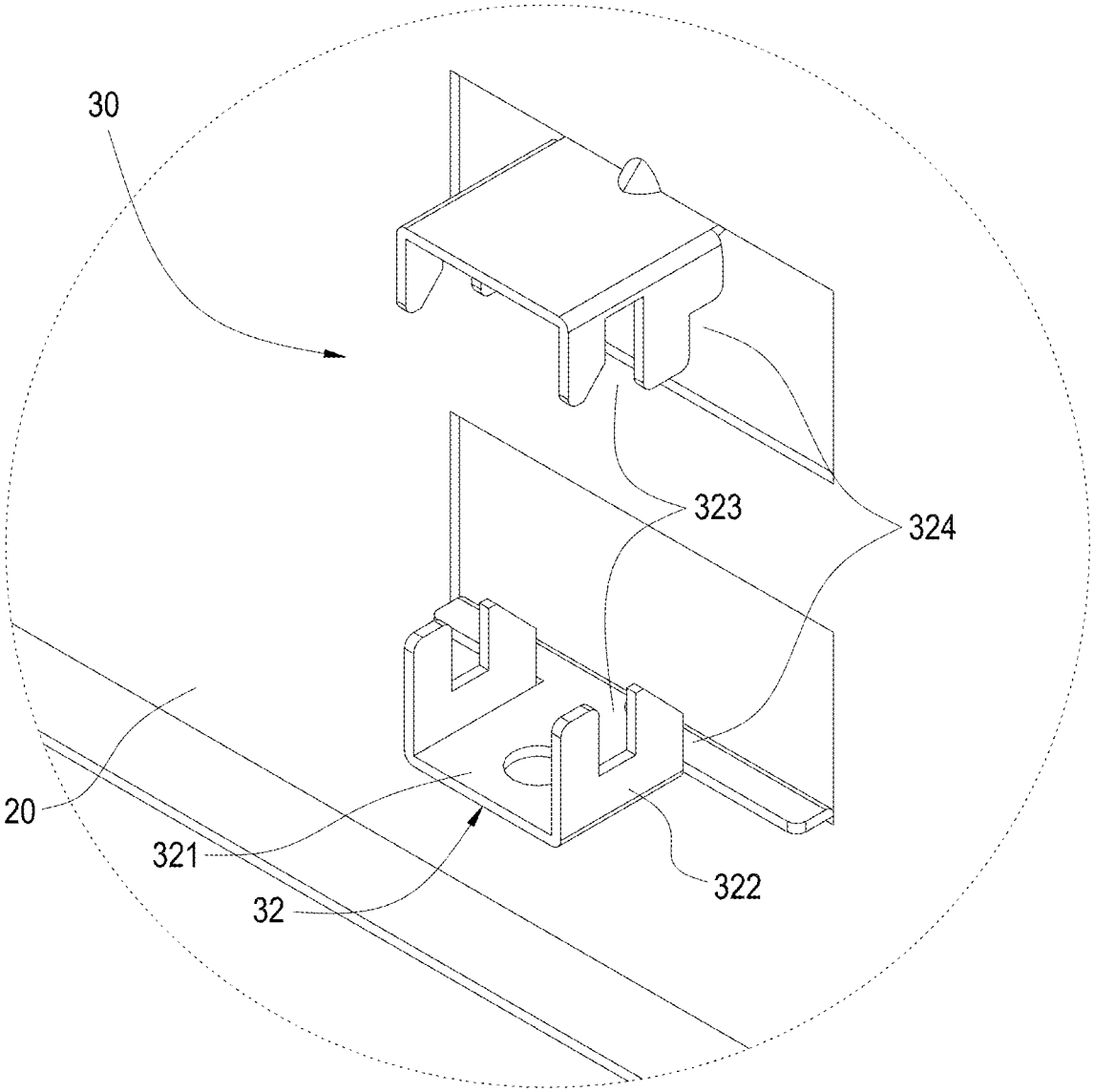
FIG. 6 illustrates a partially enlarged schematic view of the first embodiment of the upper supporting structure in this disclosure.

Please further refer to FIG. 6, which depicts a partially enlarged schematic view of the first embodiment of the upper supporting structure in this disclosure. In this embodiment, the fixing part 32 of the upper supporting structure 30 includes a supporting plate 321, a claw portion 322 connected to the supporting plate 321 and a first through groove 323. Moreover, the supporting plate 321 extends vertically from the wall of the housing 20 in the direction away from the interior of the housing 20. The first through groove 323 is defined on the claw portion 322. The first through groove 323 is defined on the outer side of the claw portion 322, that is, away from the housing 20.

It should be noted that the fixing part 32 further includes a second through groove 324 located on the inner side of the claw portion 322 close to the housing 20. The bottoms of the first through groove 323 and the second through groove 324 are located at different height positions relative to the supporting plate 321.

Figure 7:
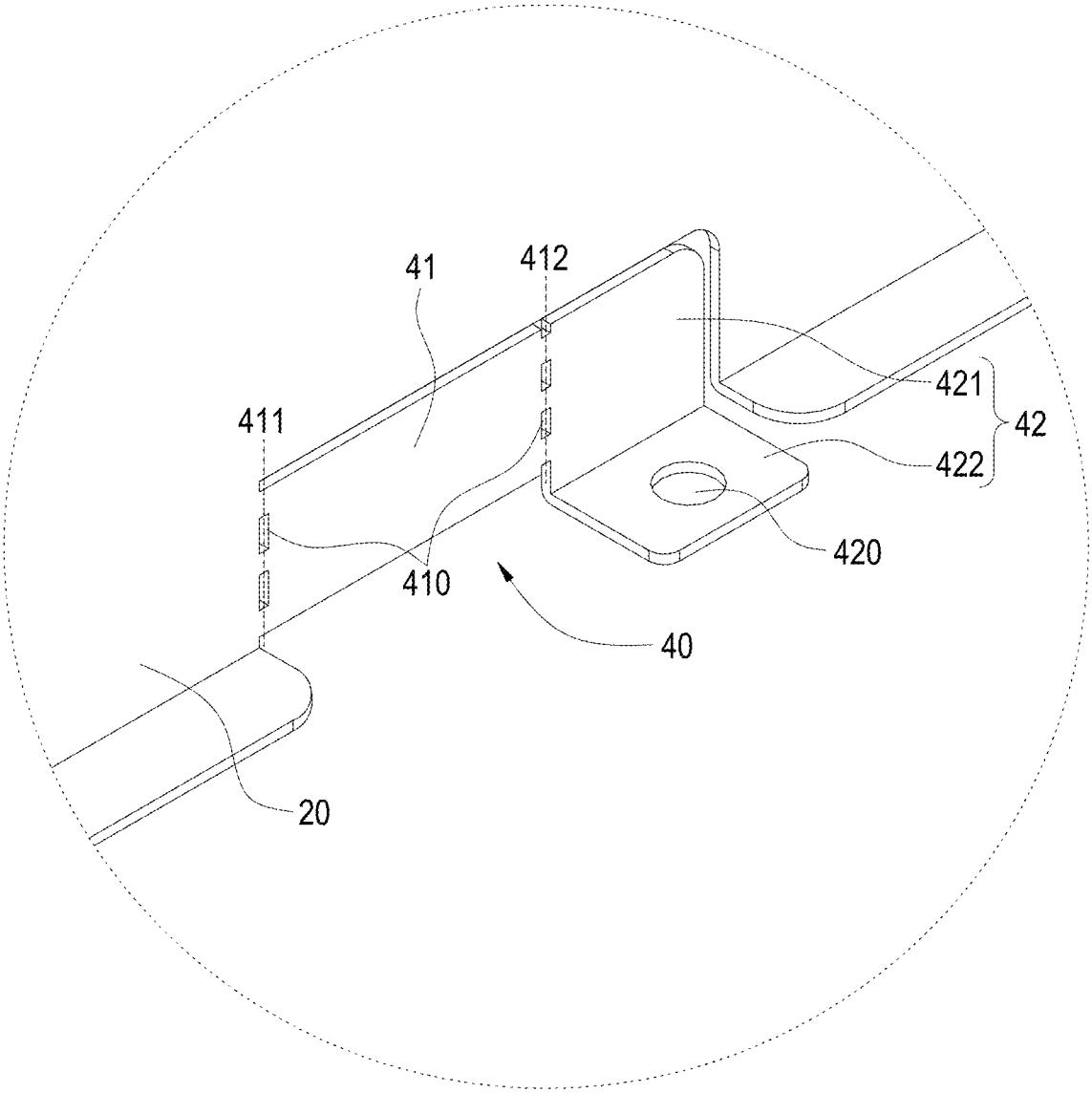
FIG. 7 illustrates a partially enlarged schematic view of the first embodiment of the lower supporting structure in this disclosure.

Please further refer to FIG. 7, which depicts a partially enlarged schematic view of the first embodiment of the lower supporting structure in this disclosure. The first embodiment of the lower supporting structure 40 in this disclosure includes a bending arm 41 and a clamping piece 42. The bending arm 41 includes a first bending edge 411 and a second bending edge 412. The first bending edge 411 is connected to the housing 20, and the second bending edge 412 is located on the opposite side of the first bending edge 411. Additionally, a plurality of bending holes 410 are defined on both the first bending edge 411 and the second bending edge 412. The arrangement of the bending holes 410 facilitates bending of the first bending edge 411 and the second bending edge 412.

Furthermore, the clamping piece 42 is in an L shape and includes a second bending section 421 and a third bending section 422. The second bending section 421 is connected to the bending arm 41. The third bending section 422 bends and extends from the second bending section 421 in the direction away from the interior of the housing 20. In this embodiment, a fixing hole 420 is also defined on the second bending section 421.

Referring to FIGS. 4 and 7, when installing the housing positioning structure 1, the bending arm 41 needs to be pressed. The bending arm 41 bends along the first bending edge 411 to make the bending arm 41 bend outwardly away from the interior of the housing 20. Subsequently, the clamping piece 42 is pressed, and the clamping piece 42 bends along the second bending edge 412 to attach to two sides of the board 10.

Figure 8:
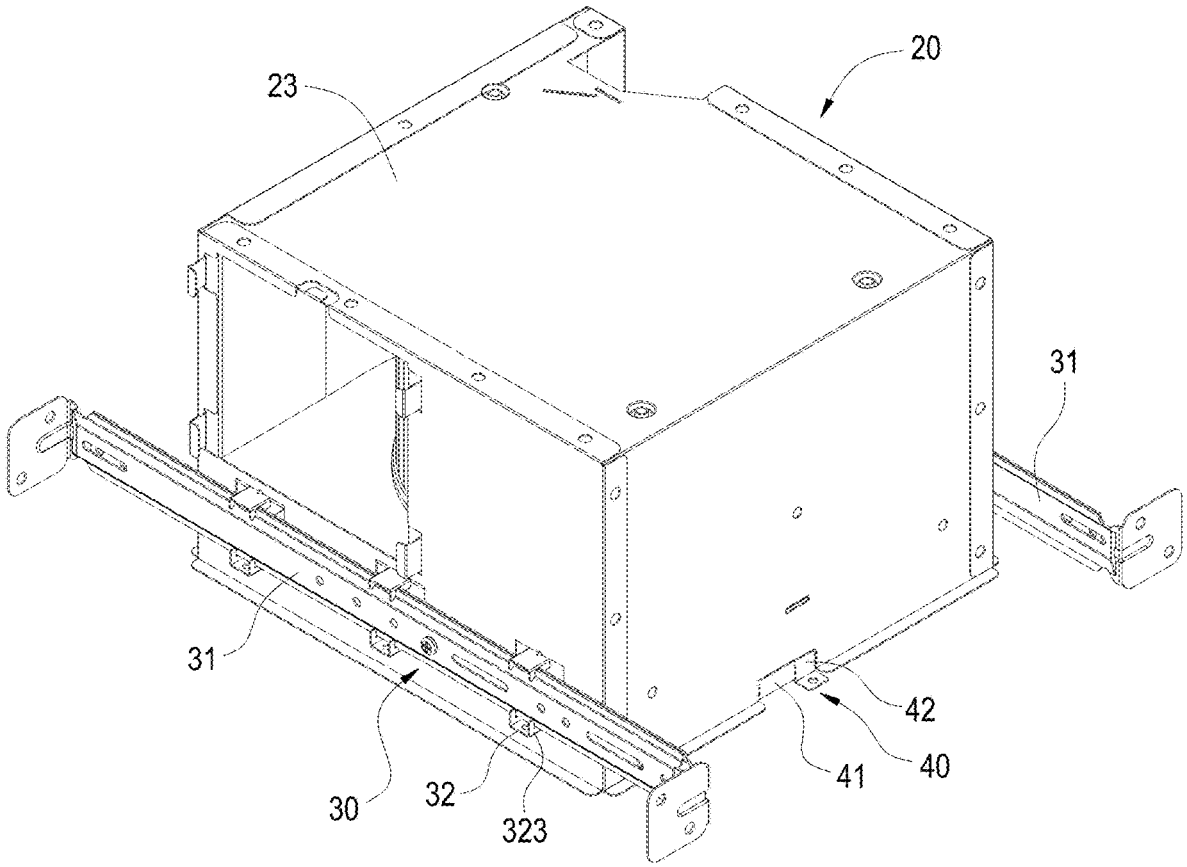
FIG. 8 illustrates an application schematic view of the first embodiment of the upper supporting structure and the first embodiment of the lower supporting structure in this disclosure.

Please refer to FIG. 8, which depicts an application schematic view of the first embodiment of the upper supporting structure and the first embodiment of the lower supporting structure in this disclosure. The upper supporting structure 30 is disposed on two sides of the housing 20 opposite to each other and includes a plurality of brackets 31 and a plurality of fixing parts 32 arranged in pairs. A first through groove is defined on each fixing part 32 and located on the outer side of the claw portion 322 and away from the housing 20. Additionally, the lower supporting structure 40 is disposed as in the aforementioned first embodiment and includes a bending arm 41 and a clamping piece 42. Moreover, the difference in this embodiment is that the bracket 31 is inserted in the first through groove 323 located on the outer side of the claw portion 322.

Figure 9:
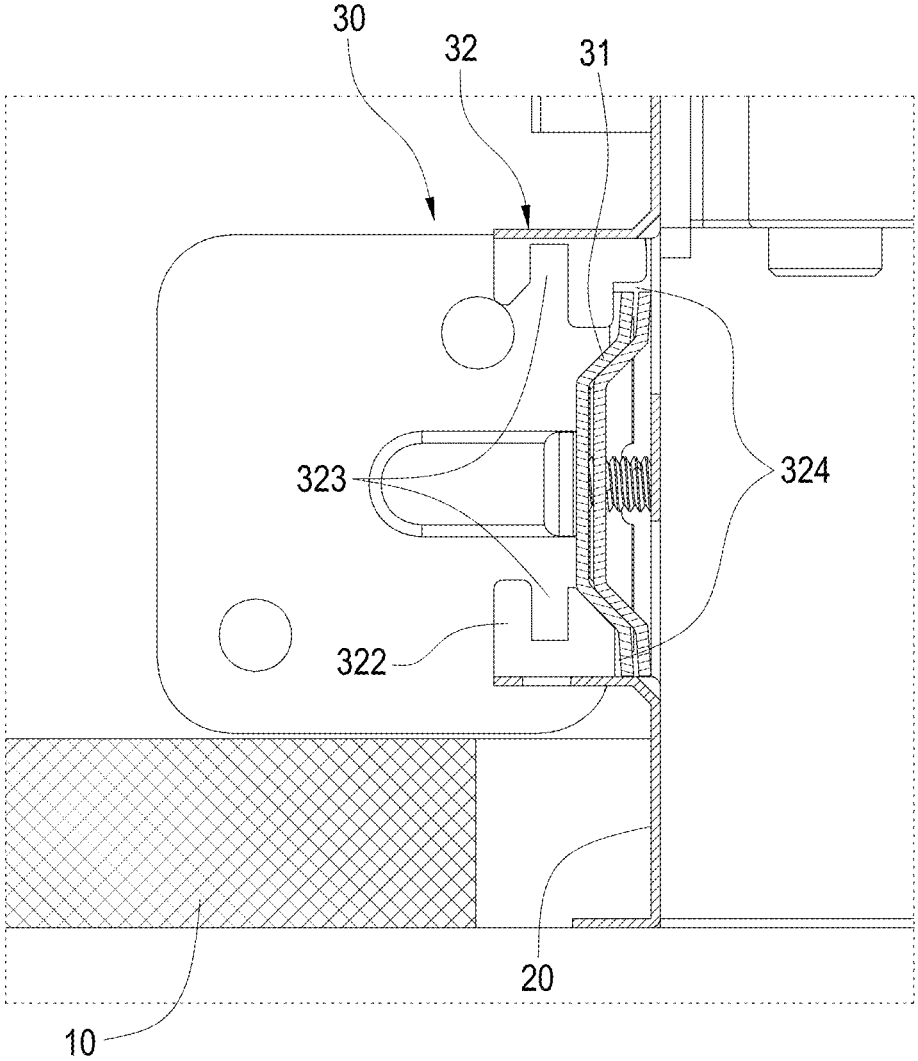
FIG. 9 illustrates a cross-sectional view of the installation of the first embodiment of the upper supporting structure in this disclosure.

Please further refer to FIG. 9, which depicts a cross-sectional view of the installation of the first embodiment of the upper supporting structure in this disclosure. In the first embodiment of the upper supporting structure 30 in this disclosure, the fixing part 32 includes a first through groove 323 located on the outer side of the claw portion 322 and a second through groove 324 located on the inner side of the claw portion 322.

It should be noted that since the first through groove 323 and the second through groove 324 are located at different height positions relative to the board 10. Therefore, the insertion position of the bracket 31 may be selected according to the thickness of the board 10 during installation of the housing positioning structure 1.

In some embodiments, the thickness of the board 10 of the housing positioning structure 1 in this disclosure comes is ½ inch or ⅝ inch when used as a ceiling. When the thickness of the board 10 is ½ inch, the bracket 31 is inserted in the second through groove 324 close to the housing 20, as shown in FIG. 1 or FIG. 2, to ensure that the bottom side of bracket 31 is flush with the board 10.

Figure 10:
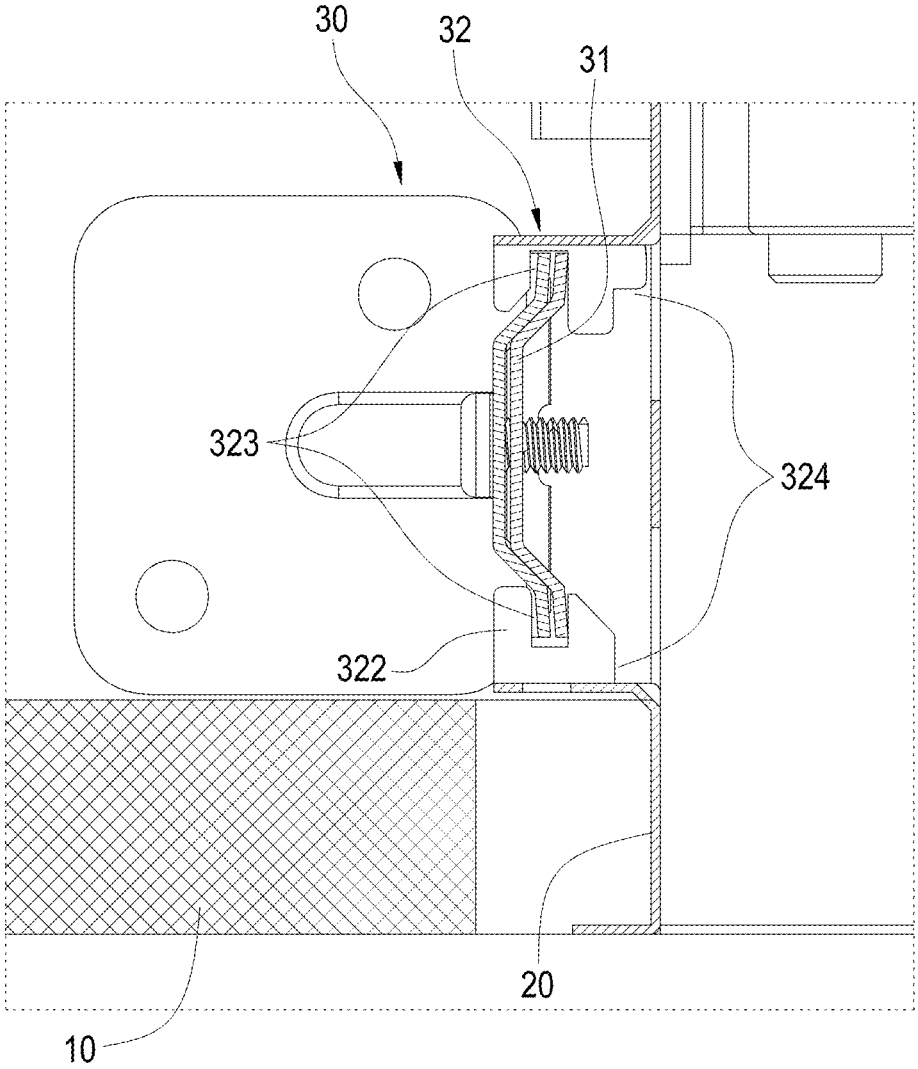
FIG. 10 illustrates another cross-sectional view of the installation of the first embodiment of the upper supporting structure in this disclosure.

Please refer to FIG. 10, which depicts another cross-sectional view of the installation of the first embodiment of the upper supporting structure in this disclosure. As shown in FIG. 9, the fixing part 32 of the upper supporting structure 30 includes a first through groove 323 located on the outer side of the claw portion 322 and a second through groove 324 located on the inner side of the claw portion 322.

When the thickness of the board 10 is ⅝ inch, the bracket 31 is inserted in the first through groove 323 away from the housing 20, as shown in FIG. 8, to ensure that the bottom side of the bracket 31 is flush with the board 10.

Figure 11:
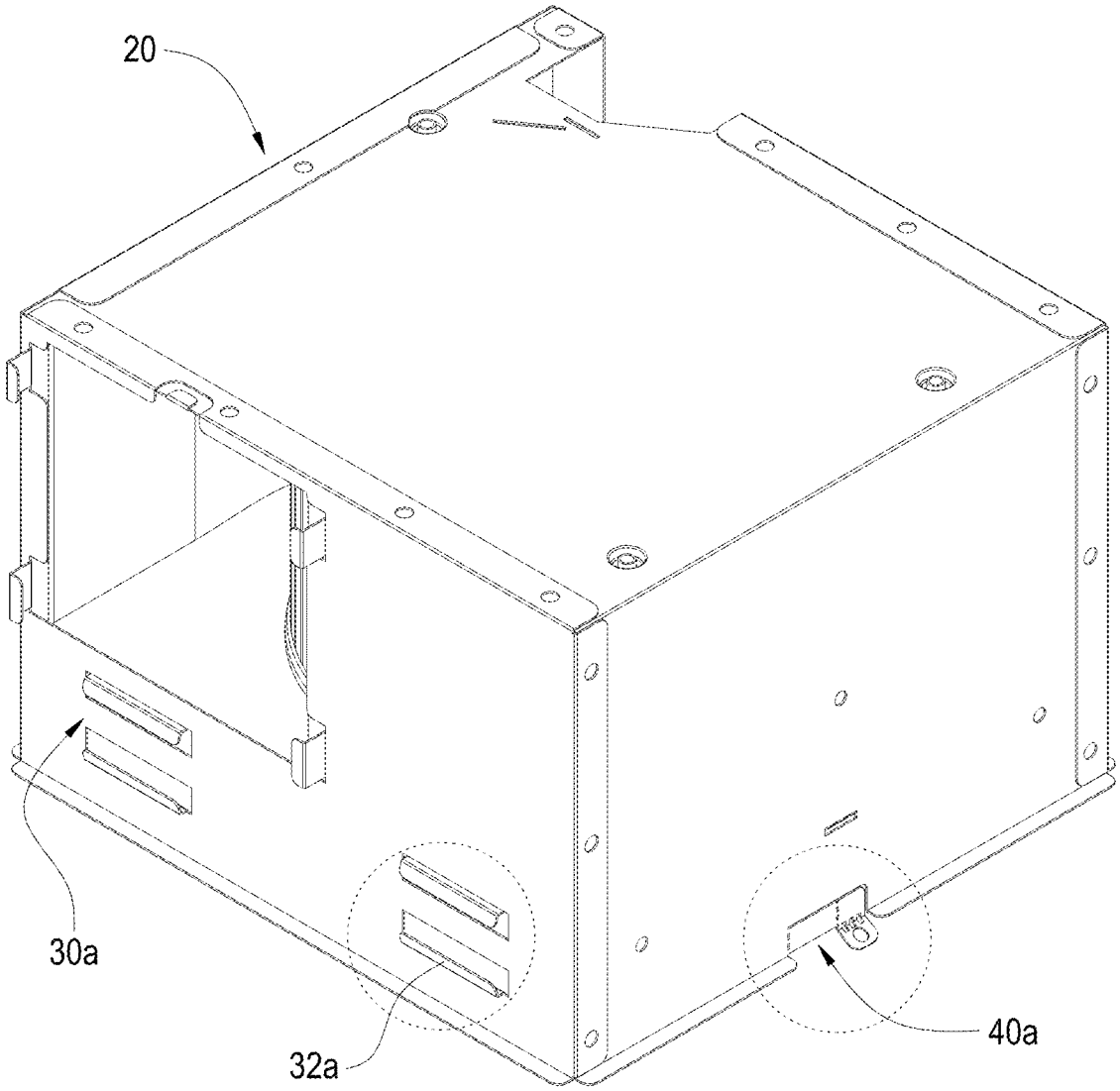
FIG. 11 illustrates an arrangement schematic view of the second embodiment of the upper supporting structure and the second embodiment of the lower supporting structure in this disclosure.

FIG. 11 depicts an arrangement schematic view of the second embodiment of the upper supporting structure and the second embodiment of the lower supporting structure in this disclosure. In this embodiment, the upper supporting structure 30*a* is disposed on two sides of the housing 20 opposite to each other. Additionally, the lower supporting structure 40*a* is disposed on another two sides of the housing 20 opposite to each other. The upper supporting structure 30*a* and the lower supporting structure 40*a* are located on different side plates 22 of the housing 20. In some embodiments, the upper supporting structure 30*a* and the lower supporting structure 40*a* may also be located on the same side of the housing 20, but this is not limited thereto.

Further, the upper supporting structure 30*a* includes a plurality of fixing parts 32*a* arranged in pairs and spacedly. Additionally, the second embodiment of the supporting structure 30*a* in this disclosure is to structure each fixing part 32*a* as an L-shaped piece.

Figure 12:
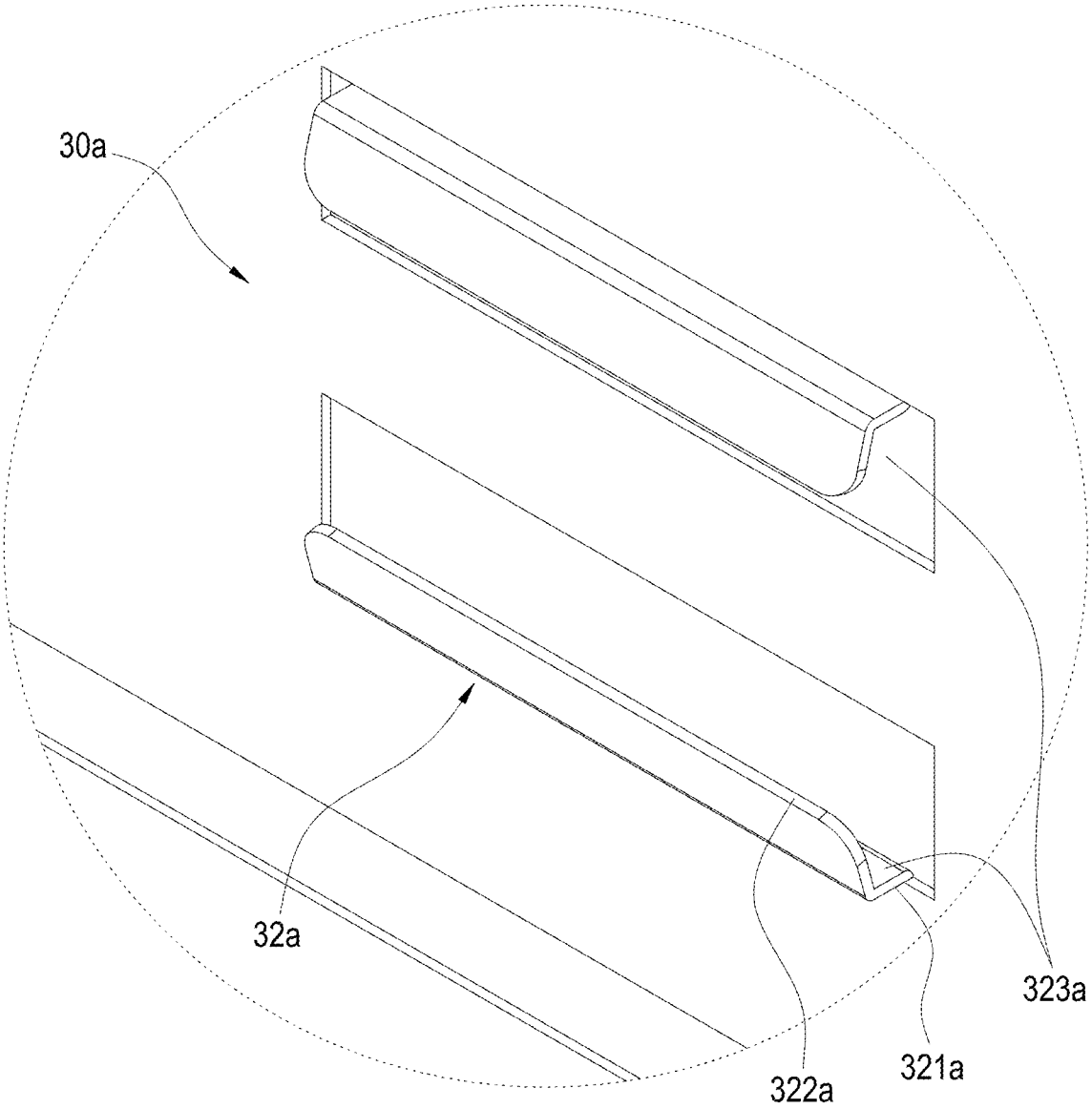
FIG. 12 illustrates a partially enlarged schematic view of the second embodiment of the upper supporting structure in this disclosure.

Please further refer to FIG. 12, which depicts a partially enlarged schematic view of the second embodiment of the upper supporting structure in this disclosure. In this embodiment, each of the fixing parts 32*a* includes a supporting piece 321*a* extending vertically and outwardly from the wall of the housing 20 and a blocking piece 322*a* bending and extending from the supporting piece 321*a*. Additionally, a first through groove 323*a* is defined between the supporting piece 321*a* and the blocking piece 322*a*.

Figure 13:
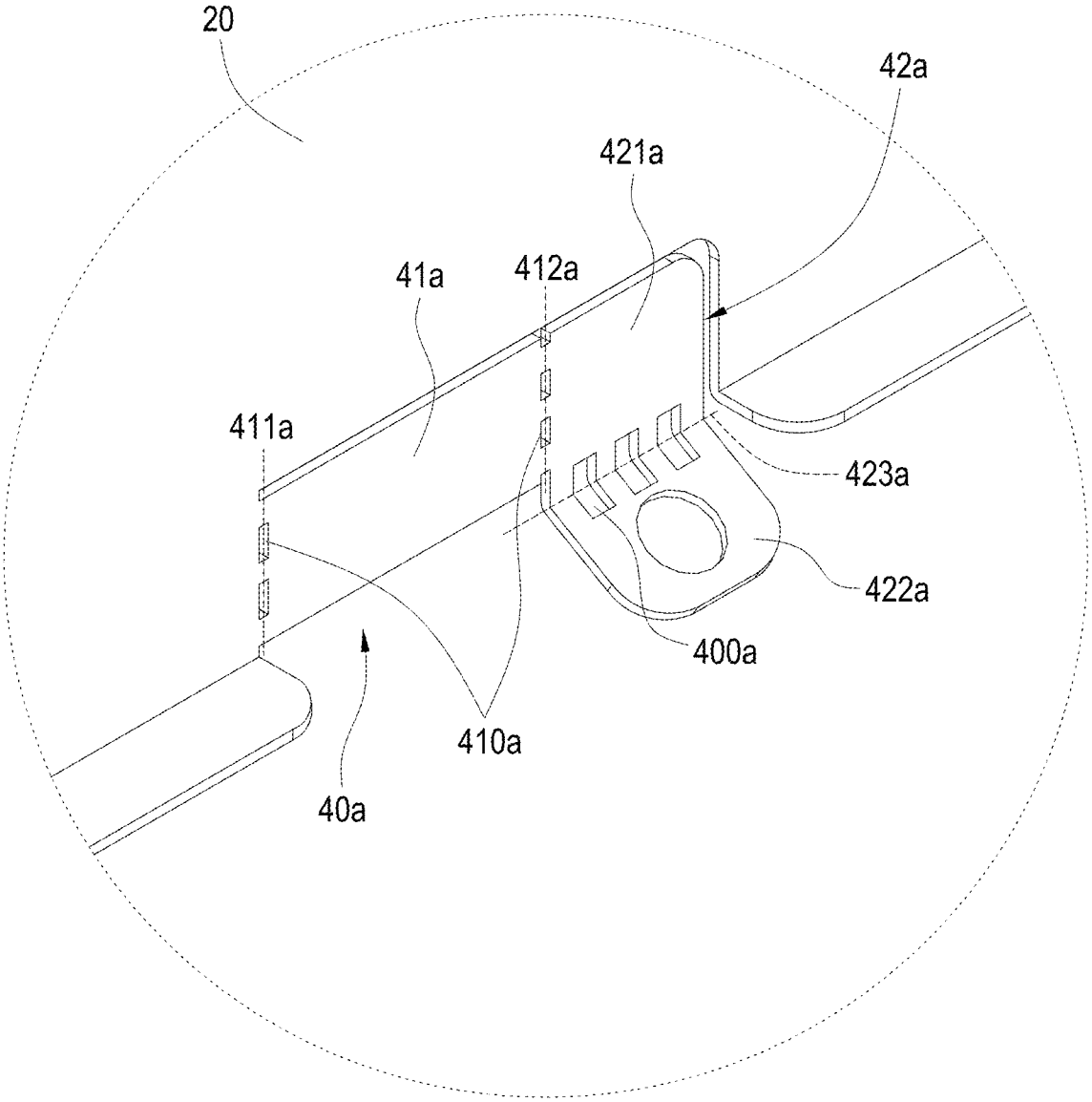
FIG. 13 illustrates a partially enlarged schematic view of the second embodiment of the lower supporting structure in this disclosure.

Please refer to FIG. 13, which depicts a partially enlarged schematic view of the second embodiment of the lower supporting structure in this disclosure. The second embodiment of the lower supporting structure 40 in this disclosure includes a bending arm 41*a* and a clamping piece 42*a*. The bending arm 41*a* includes a first bending edge 411*a* and a second bending edge 412*a*. The first bending edge 411*a* is connected to the housing 20. The second bending edge 412*a* is located on the opposite side of the first bending edge 411*a*. Additionally, a plurality of bending holes 410*a* are defined both on the first bending edge 411*a* and the second bending edge 412*a*. The arrangement of the plurality of bending holes 410*a* facilitates bending of the first bending edge 411*a* and the second bending edge 412*a*.

Furthermore, the clamping piece 42*a* is in an L shape and includes a second bending section 421*a* and a third bending section 422*a*. The second bending section 421*a* is connected to the bending arm 41*a*. The third bending section 422*a* bends and extends from the second bending section 421*a* in the direction away from the interior of the housing 20.

The difference of this embodiment is that the connection portion between the second bending section 421*a* and the third bending section 422*a* is the third bending edge 423*a*. Moreover, a plurality of bending slots 400*a* are defined on the third bending edge 423*a*, and each bending slot 400*a* is in an L shape. The arrangement of the plurality of bending slot 400*a* facilitates bending of the third bending edge 423*a*.

Figure 14:
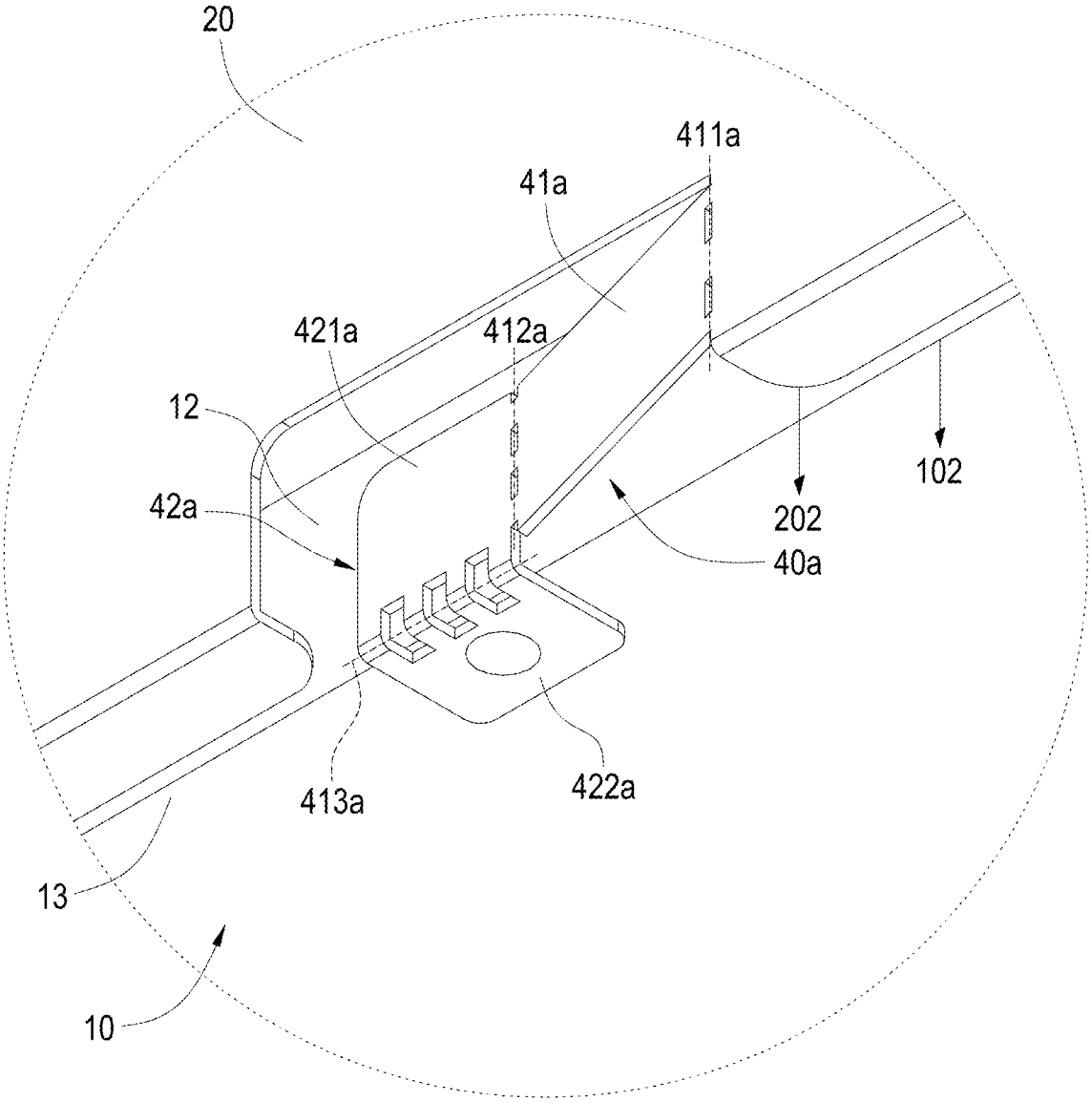
FIG. 14 illustrates a schematic view of the second embodiment of the lower supporting structure after installation in this disclosure.

Please refer to FIG. 14, which depicts a schematic view of the second embodiment of the lower supporting structure after installation in this disclosure. When installing the housing 20, the bending arm 41*a* needs to be pressed. The bending arm 41*a* bends along the first bending edge 411*a* to make the bending arm 41*a* bend outwardly in the direction away from the interior of the housing 20. Subsequently, the clamping piece 42*a* is pressed, and the clamping piece 42 bends along the second bending edge 412*a* to make the clamping piece 42*a* attach to the two sides of the board 10. That is, the second bending section 421*a* attaches the board thickness surface 12 of the board 10. Additionally, the third bending section 422*a* attaches the board surface 13 facing the below-board direction side 102.

It should be noted that the third bending section 422*a* of the clamping piece 42*a* is pressed when the thickness of the board 10 is thicker. Additionally, the third bending section 422*a* bends along the third bending edge 423*a*, thereby changing the angle between the second bending section 421*a* and the third bending section 422*a* to make the third bending section 422*a* attach to the board surface 13.

Figure 15:
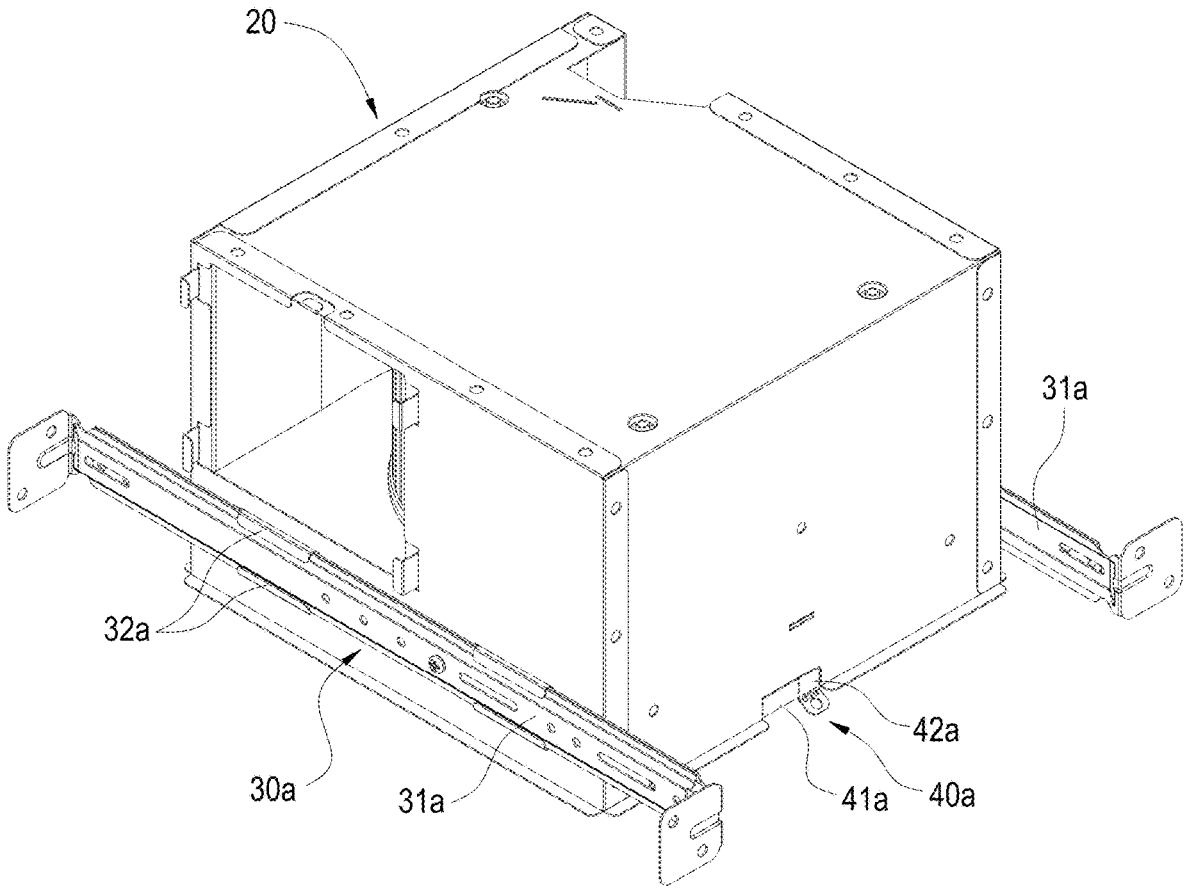
FIG. 15 illustrates an application schematic view of the second embodiment of the upper supporting structure and the second embodiment of the lower supporting structure in this disclosure.

Please further refer to FIG. 15, which depicts an application schematic view of the second embodiment of the upper supporting structure and the second embodiment of the lower supporting structure in this disclosure. The upper supporting structure 30*a* is disposed on opposite sides of the housing 20 and includes a plurality of brackets 31*a* and a plurality of fixing parts 32*a* arranged in pairs. The fixing part 32*a* is structured as an L-shaped piece. Moreover, the lower supporting structure 40*a* is as described in the aforementioned second embodiment and includes a bending arm 41*a* and a clamping piece 42*a*. Additionally, the brackets 31*a* are inserted in the multiple fixing parts 32*a*.

Figure 16:
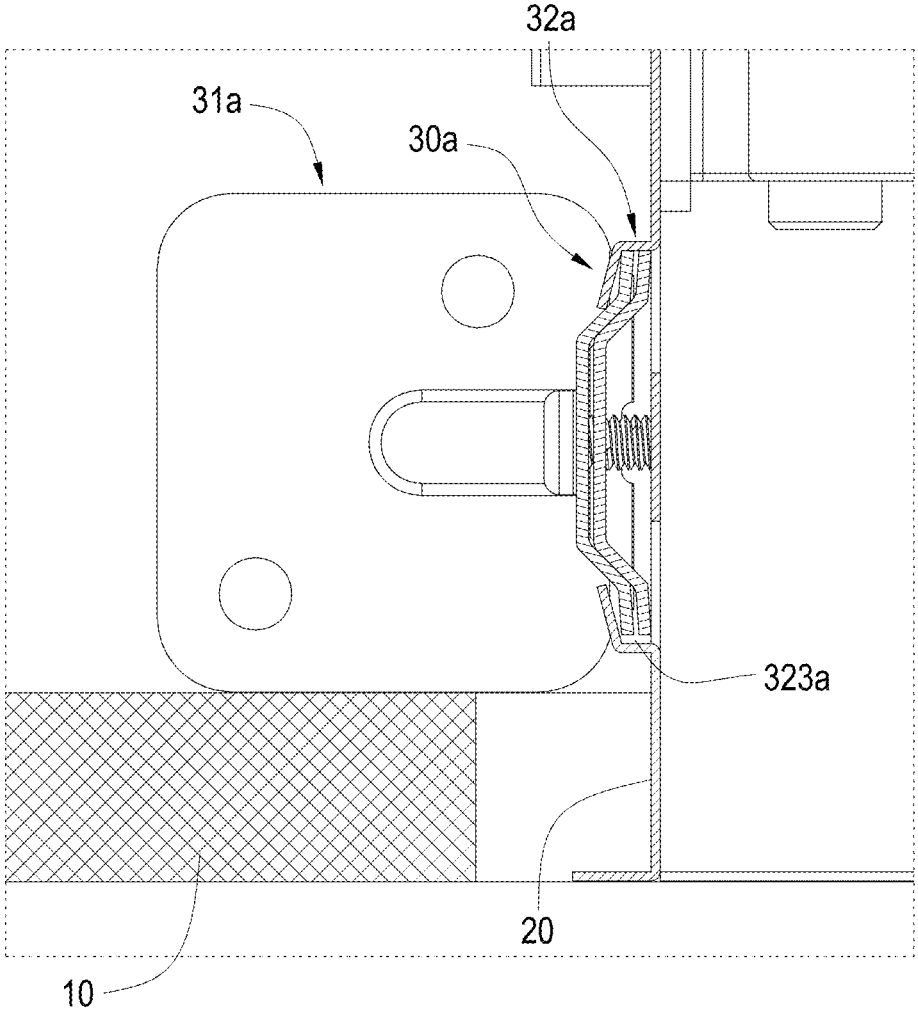
FIG. 16 illustrates a cross-sectional view of the installation of the second embodiment of the upper supporting structure in this disclosure.

Please refer to FIG. 16, which depicts a cross-sectional view of the installation of the second embodiment of the upper supporting structure in this disclosure. In the second embodiment of the upper supporting structure 30*a* in this disclosure, the fixing part 32*a* is structured as an L-shaped piece, and a first through groove 323*a* is defined on the fixing part 32*a*. Moreover, the bracket 31*a* is inserted in the first through groove 323*a* to ensure that the bottom side of the bracket 31*a* is flush with the plate body 10, and the housing 20 is positioned on the board 10.

Figure 17:
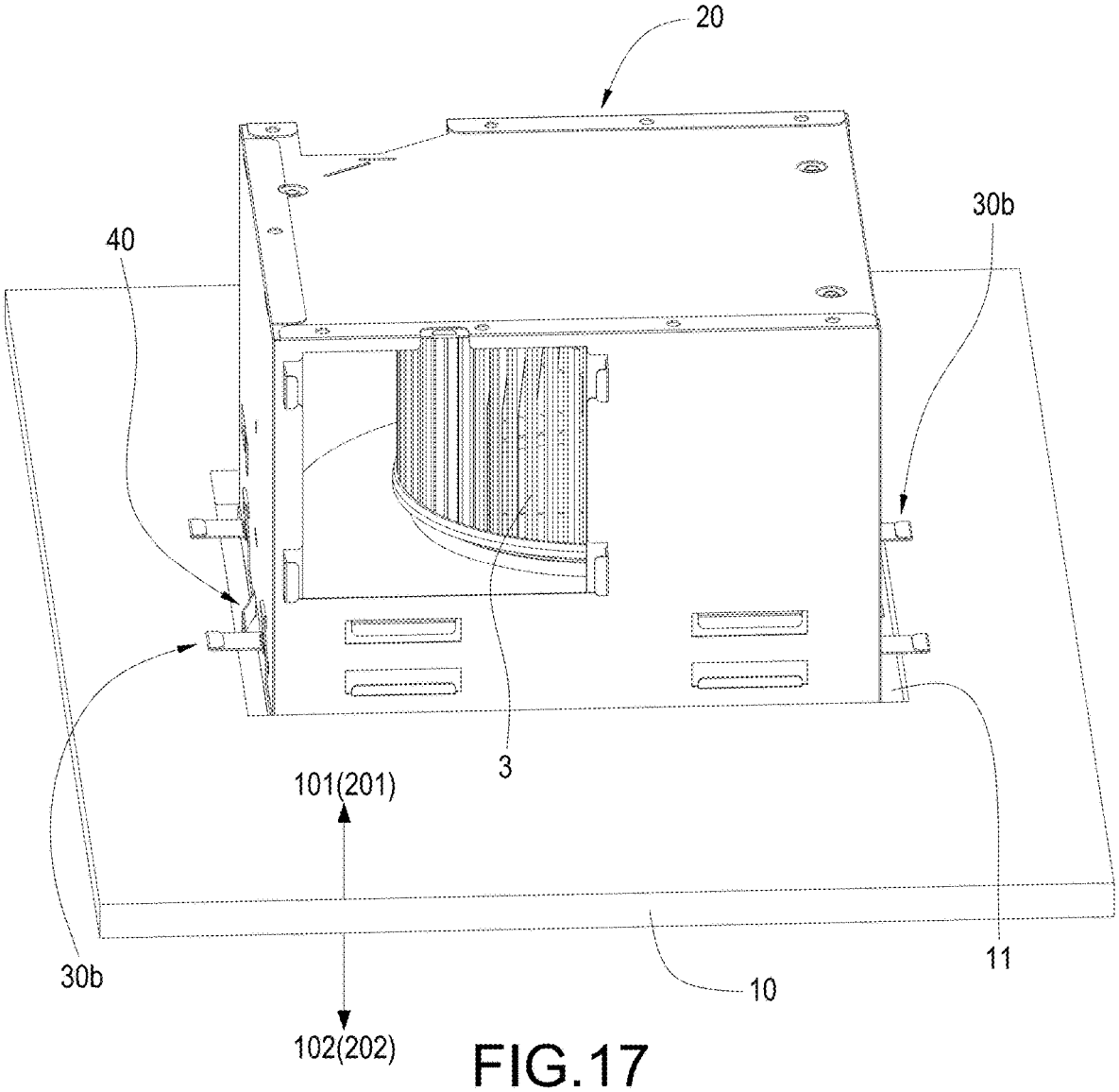
FIG. 17 illustrates a schematic view of another embodiment of the housing positioning structure after installation in this disclosure.

Please refer to FIG. 17, which depicts a schematic view of another embodiment of the housing positioning structure after installation in this disclosure. In this embodiment, the upper supporting structure 30*b* is structured as in the third embodiment, and the lower supporting structure 40 is structured as in the first embodiment. In some embodiments, the lower supporting structure 40 may also be structured as in the second embodiment.

The upper supporting structure 30*b* is located on the above-board direction 101 side and is disposed on two sides of the housing 20 opposite to each other. Additionally, the upper supporting structure 30*b* is placed directly at the installation opening 11 on the above-board direction 101 side without using any bracket. The part of the housing 20 located on the above-board direction 101 side is supported and positioned by the upper supporting structure 30*b*.

Furthermore, the lower supporting structure 40 is disposed on one side of the housing 20 adjacent to the board 10. The lower supporting structure 40 extends toward the below-board direction 102 side to attach the board 10, thereby restricting the housing 20 from the below-board direction 102.

In this embodiment, a ventilation fan 3 is installed in the housing 20. The ventilation fan 3 and the housing 20 are supported and positioned by the upper supporting structure 30 and the lower supporting structure 40 for combining in the installation opening 11.

Figure 18:
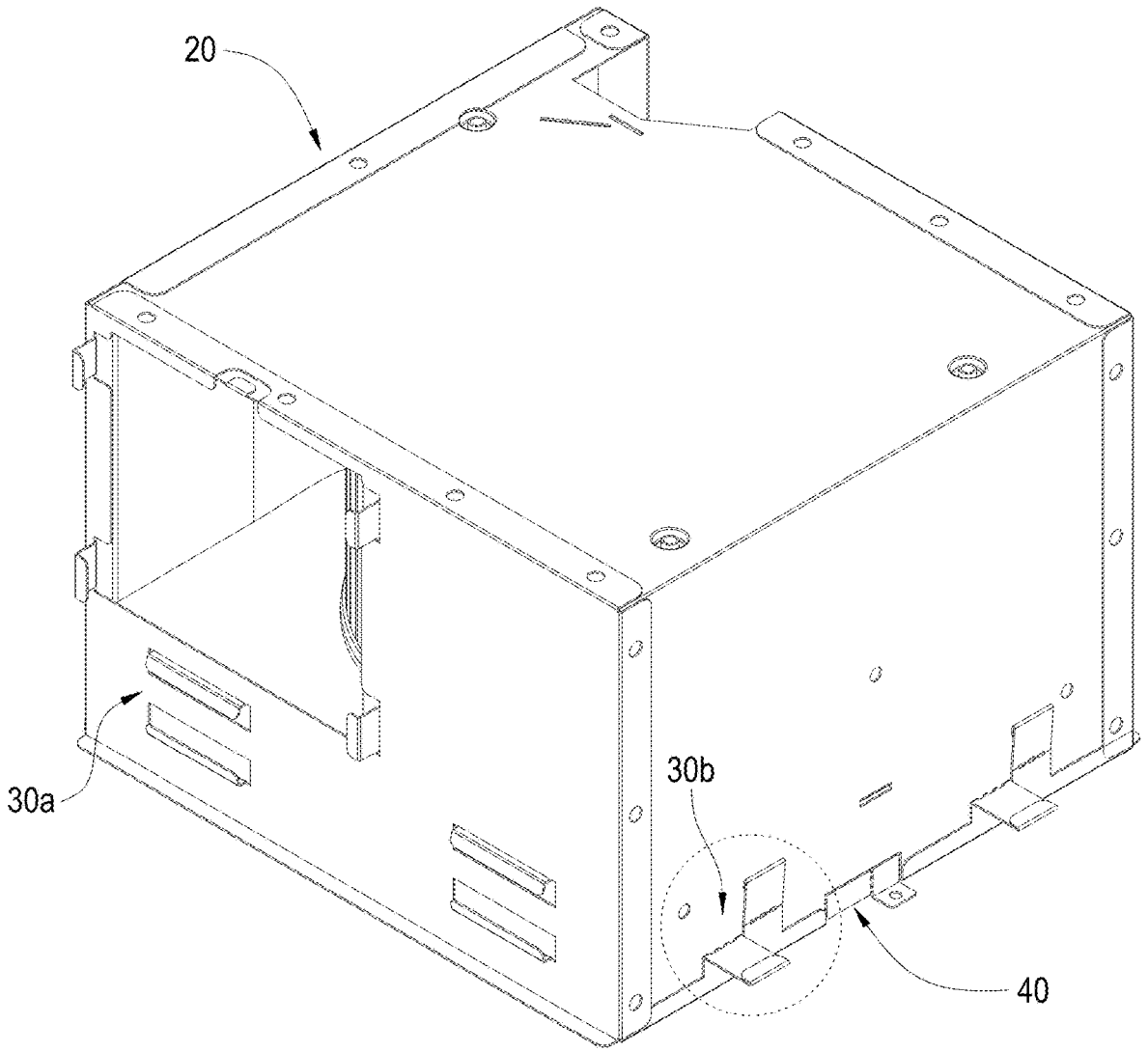
FIG. 18 illustrates an arrangement schematic view of the third embodiment of the upper supporting structure and the first embodiment of the lower supporting structure in this disclosure.

Please refer to FIG. 18, which depicts an arrangement schematic view of the third embodiment of the upper supporting structure and the first embodiment of the lower supporting structure in this disclosure. In this embodiment, the upper supporting structure 30*b* includes a plurality of bendable wing plates arranged in pairs on two sides of the housing 20 opposite to each other. Furthermore, the upper supporting structure 30*b* and the lower supporting structure 40 are located on the same side of the housing 20. In some embodiments, the upper supporting structure 30*b* and the lower supporting structure 40 may be located on different sides of the housing 20.

It should be noted that the upper supporting structure 30*a* of the second or first embodiment may be disposed on another two sides of the housing 20 opposite to each other for optional or backup use. Additionally, the lower supporting structure 40 may be structured as in the second embodiment.

Figure 19:
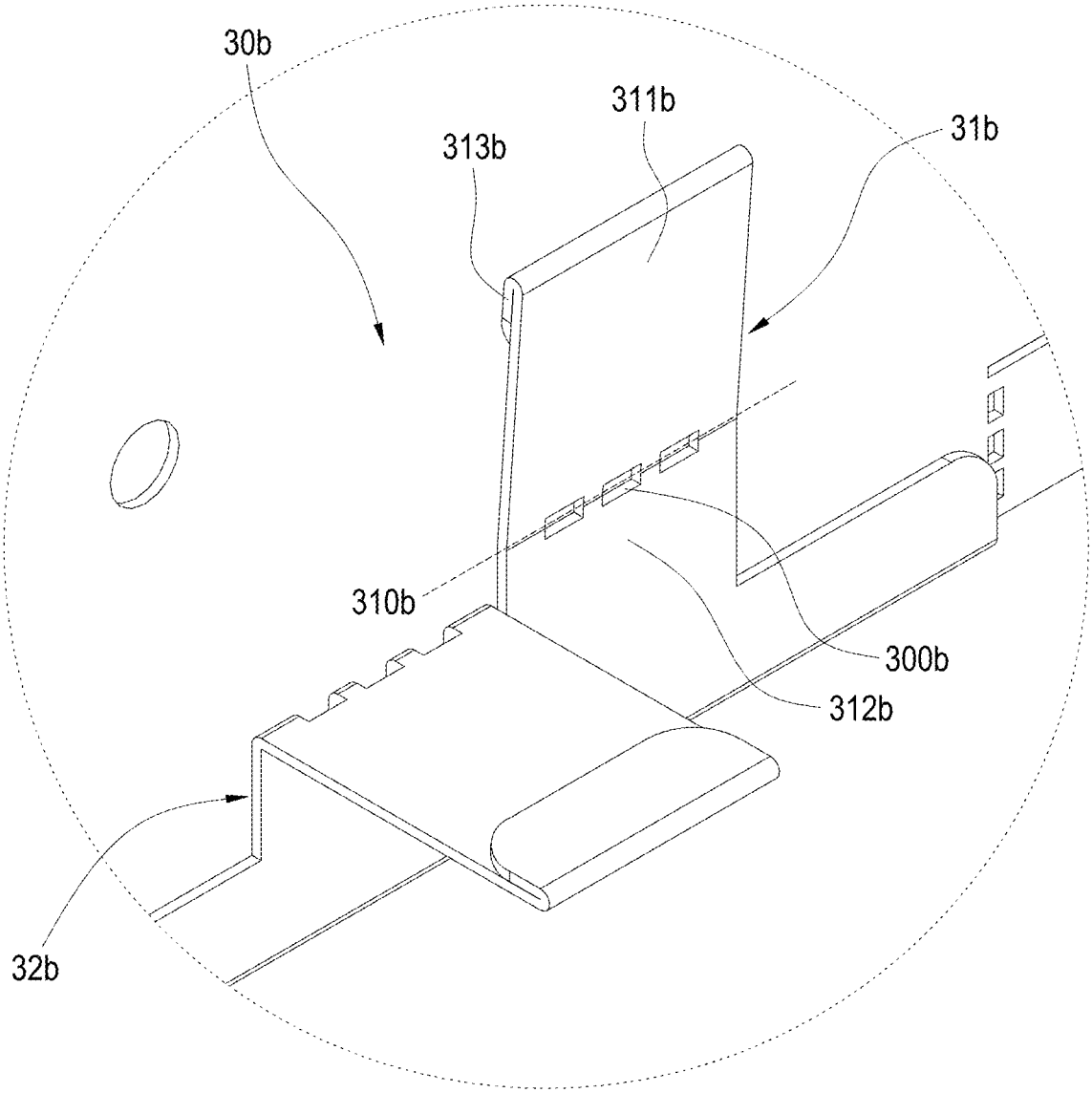
FIG. 19 illustrates a partially enlarged schematic view of the third embodiment of the upper supporting structure in this disclosure.

Please further refer to FIG. 19, which depicts a partially enlarged schematic view of the third embodiment of the upper supporting structure in this disclosure. In this embodiment, the upper supporting structure 30*b* includes a plurality of first wing plates 31*b* and a plurality of second wing plates 32*b*. The plural first wing plates 31*b* and the plural second wing plates 32*b* are symmetrically arranged on the housing 20. Furthermore, the plurality of first wing plates 31*b* and the second wing plates 32*b* are located on the bottom side of the housing 20 and have different heights after being bent.

Specifically, the first wing plate 31*b* includes a first extension piece 311*b* and a first bending piece 312*b*. The first extension piece 311*b* is attached to the wall of the housing 20. The first bending piece 312*b* is connected to the first extension piece 311*b* and bends outwardly in the direction away from the housing 20 to attach the board 10. In this embodiment, the first wing plate 31*b* further includes a first return fold 313*b* bent from one end of the first bent piece 312*b*. The first return fold 313*b* is designed to prevent users from getting cut.

Furthermore, a plurality of first bending holes 300*b* are arranged spacedly on the first wing plate 31*b* and are located between the first extension piece 311*b* and the first bending piece 312*b*. The arrangement of the plurality of first bending holes 300*b* facilitates the formation of a first bending line 310*b* between the first extension piece 311*b* and the first bending piece 312*b*, thereby making it easier to bend along the first bending line 310*b*.

Figure 20:
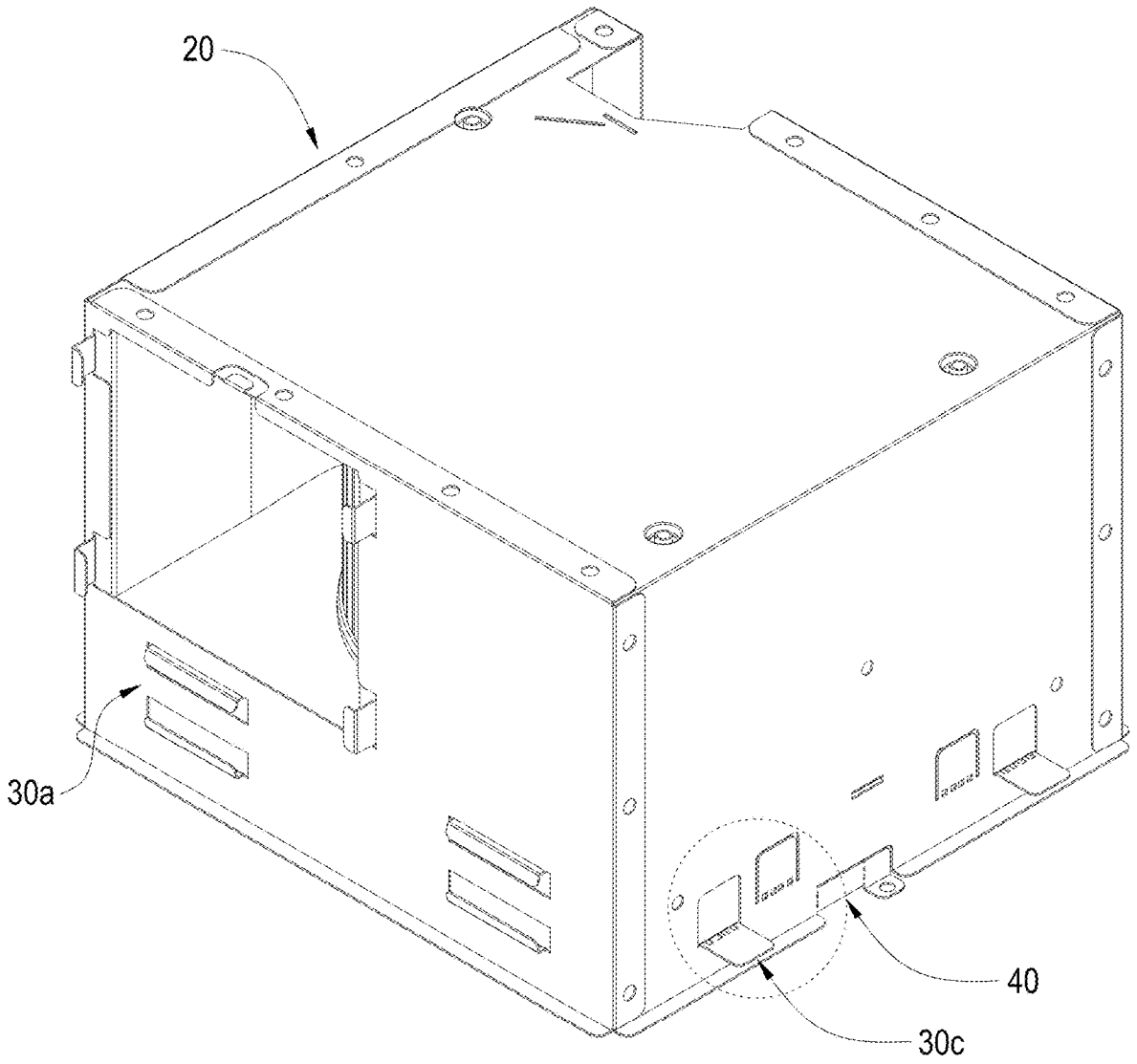
FIG. 20 illustrates an arrangement schematic view of the fourth embodiment of the upper supporting structure and the first embodiment of the lower supporting structure in this disclosure.

With reference to FIG. 20, which depicts an arrangement schematic view of the fourth embodiment of the upper supporting structure and the first embodiment of the lower supporting structure in this disclosure. In this embodiment, an upper supporting structure 30*c* and a lower supporting structure 40 are disposed on the housing 20. The upper supporting structure 30*c* includes a plurality of bending plates arranged in pairs on two sides of the housing 20 opposite to each other. These bending plates bend outwardly in the direction away from the housing 20.

Furthermore, the upper supporting structure 30*c* and the lower supporting structure 40 are located on the same side of the housing 20. In some embodiments, however, the upper supporting structure 30*c* and the lower supporting structure 40 may also be located on different sides of the housing 20.

Similarly, the upper supporting structure 30*a* of the second embodiment, the same as the first or third embodiment, may be disposed on another two sides of the housing 20 opposite to each other for optional or backup use. Additionally, the lower supporting structure 40 may be structured as in the second embodiment.

Figure 21:
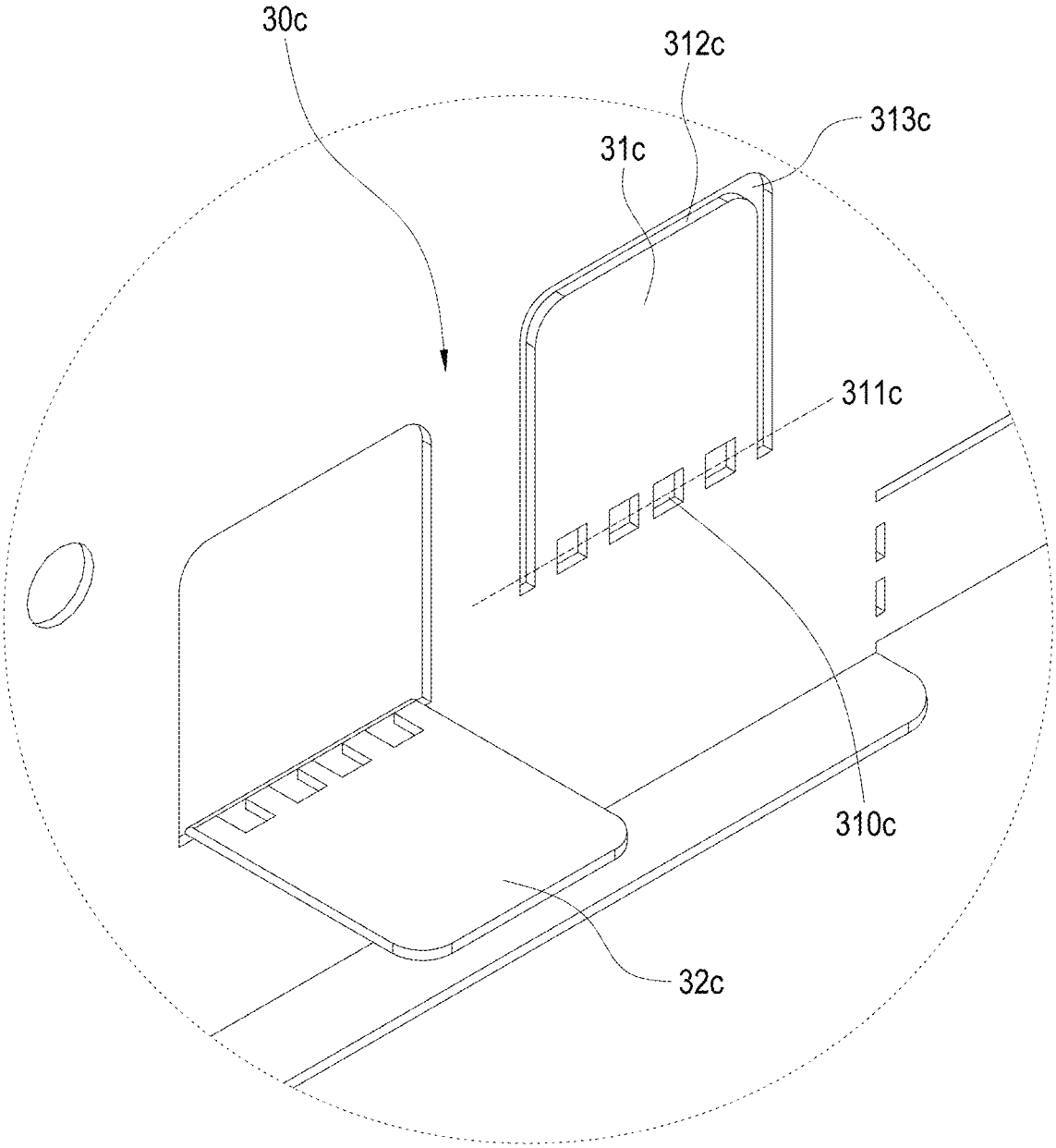
FIG. 21 illustrates a partially enlarged schematic view of the fourth embodiment of the upper supporting structure in this disclosure.

Please further refer to FIG. 21, which depicts a partially enlarged schematic view of the fourth embodiment of the upper supporting structure in this disclosure. In this embodiment, the upper supporting structure 30*c* includes a plurality of first bending plates 31*c* and a plurality of second bending plates 32*c*. The first bending plates 31*c* and the second bending plates 32*c* are located on the bottom side of the housing 20 and have different heights after being bent.

Specifically, the first bending plate 31*c* includes a first fixed edge 311*c* and a first folding edge 312*c*. The first fixed edge 311*c* is connected to the wall of the housing 20. The first folding edge 312*c* is bent outwardly in the direction away from the interior of the housing 20.

In this embodiment, the first bending plate 31*c* further includes a groove 313*c* surrounding the first bending plate 312*c* and a plurality of bending holes 310*c* arranged spacedly on the first fixed edge 311*c*. The arrangement of the plurality of first bending holes 310 facilitates bending of the first bending edge 311*c*.

Figure 22:
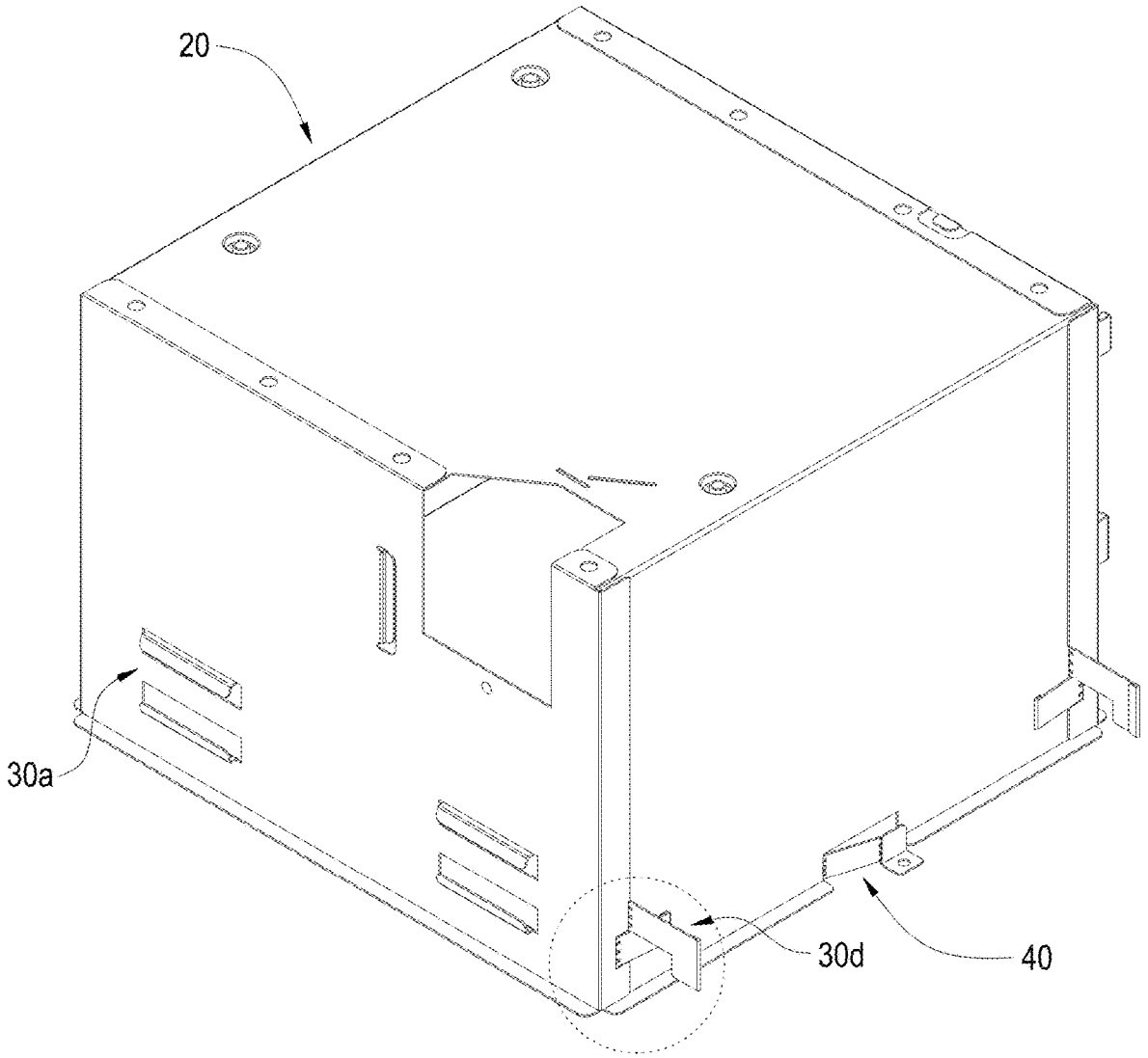
FIG. 22 illustrates an arrangement schematic view of the fifth embodiment of the upper supporting structure and the first embodiment of the lower supporting structure in this disclosure.

Please refer to FIG. 22, which depicts an arrangement schematic view of the fifth embodiment of the upper supporting structure and the first embodiment of the lower supporting structure in this disclosure. In this embodiment, the upper supporting structure 30*d* and the lower supporting structure 40 are disposed on the housing 20. The upper supporting structure 30*d* includes a plurality of flip plates attached to two sides of the housing 20 opposite to each other. The upper supporting structure 30*d* rotates horizontally away from the surface of the housing 20 in the direction away from the interior of the housing 20.

Furthermore, the upper supporting structure 30*d* and the lower supporting structure 40 are located on the same side of the housing 20. However, in some embodiments, the upper supporting structure 30*d* and the lower supporting structure 40 may also be located on different sides of the housing 20.

Similarly, the upper supporting structure 30*a* of the second embodiment, the same as the first, third or fourth embodiment, may be disposed on another two sides of the housing 20 opposite to each other for optional or backup use. Additionally, the lower supporting structure 40 may also be structured as in the second embodiment.

Figure 23:
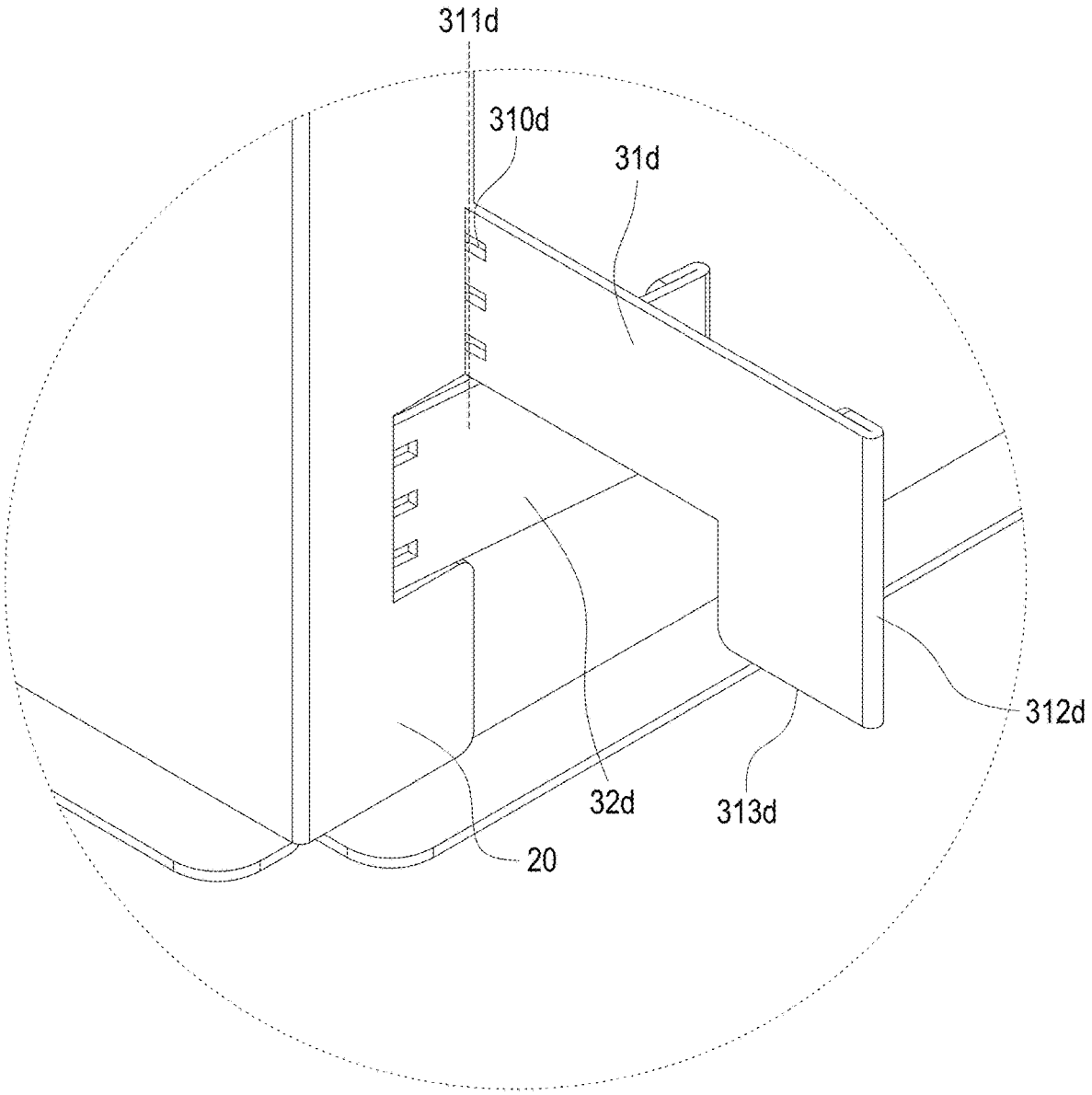
FIG. 23 illustrates a partially enlarged schematic view of the fifth embodiment of the lower supporting structure in this disclosure.

Please further refer to FIG. 23, which depicts a partially enlarged schematic view of the fifth embodiment of the lower supporting structure in this disclosure. In this embodiment, the upper supporting structure 39*d* includes a plurality of first flip plates 31*d* and a plurality of second flip plates 32*d*. Additionally, the first flip plates 31*d* and the second flip plates 32*d* are located on the bottom side of the housing 20 and have different heights after rotation.

Specifically, the first flip plate 31*d* includes a first fixed edge 311*d* and a first folding edge 312*d*. The first fixed edge 311*d* is connected to the wall of the housing 20. The first folding edge 312*c* rotates outwardly in the direction away from the interior of the housing 20. In this embodiment, the bottom side 313*d* of the first folded edge 312*d* serves as an abutment surface. Moreover, a plurality of first bending holes 310*d* are arranged spacedly on the first folded edge 312*d*. The arrangement of the plurality of first bending holes 310*d* facilitates rotating at the first bending edge 311*d*.

While this disclosure has been described by means of specific embodiments, numerous modifications and variations could be made thereto by those skilled in the art without departing from the scope and spirit of this disclosure set forth in the claims.

What is claimed is:

1. A housing positioning structure for a ventilation fan, the housing positioning structure comprising:

a housing, comprising a top plate and a plurality of side plates vertically arranged on a periphery of the top plate, wherein an accommodation space is enclosed by the top plate and the side plates, a horizontal line is formed at a lower edge of the side plate, a direction above and away the horizontal line is defined as an above-body direction side, and a direction below and away the horizontal line is defined as a below-body direction side;

an upper supporting structure, disposed on the housing and located on the above-body direction side; and a lower supporting structure, disposed on the lower edge of the side plate and extending toward the below-body direction side;

wherein the upper supporting structure comprises a plurality of brackets and a plurality of fixing parts arranged in pairs, a first through groove is defined on each fixing part, and each bracket is inserted in the first through groove; and each fixing part is a hook, each fixing part comprises a supporting plate and a claw portion connected to the supporting plate, the supporting plate extends vertically from a wall of the housing in a direction away from the accommodation space, and the first through groove is defined on the claw portion.

2. The housing positioning structure according to claim 1, wherein each fixing part comprises a second through groove, and a bottom of the first through groove and a bottom of the second through groove are located at different height positions relative to the supporting plate.

3. The housing positioning structure according to claim 1, wherein each fixing part comprises a supporting piece and a blocking piece, the supporting piece extends vertically and outwardly from a wall of the housing, and the blocking piece is bent and extends from the supporting piece.

4. The housing positioning structure according to claim 1, wherein the upper supporting structure comprises a plurality of wing plates which are bendable, and the wing plates are arranged in pairs on two sides of the housing opposite to each other; and wherein the wing plates comprise a plurality of first wing plates and a plurality of second wing plates, the first wing plates and the second wing plates are located on a bottom side of the housing and have different heights relative to the horizontal line after being bent.

5. The housing positioning structure according to claim 4, wherein the first wing plate comprises a first extension piece and a first bending piece, the first extension piece is attached to a wall of the housing, and the first bending piece is connected to the first extension piece and bendable outwardly in a direction away from the housing.

6. The housing positioning structure according to claim 5, wherein the first wing plate comprises a first return fold bending from one end of the first bending piece.

7. The housing positioning structure according to claim 5, wherein a plurality of first bending holes is arranged spacedly on the first wing plate and are located between the first extension piece and the first bending piece.

8. The housing positioning structure according to claim 1, wherein the upper supporting structure comprises a plurality of bending plates arranged in pairs on two sides of the housing opposite to each other.

9. The housing positioning structure according to claim 8, wherein the bending plates comprises a plurality of first bending plates and a plurality of second bending plates, the first bending plates and the second bending plates are located on a bottom side of the housing and have different heights relative to the horizontal line after being bent.

10. The housing positioning structure according to claim 9, wherein the first bending plate comprises a first fixed edge and a first folding edge, the first fixed edge is connected to a wall of the housing, and the first folding edge is bent outwardly in a direction away from the accommodation space.

11. The housing positioning structure according to claim 1, wherein the upper supporting structure comprises a plurality of flip plates attached to two sides of the housing opposite to each other, and the upper supporting structure is rotatable horizontally from a surface of the housing in a direction away from the accommodation space.

12. The housing positioning structure according to claim 11, wherein the flip plates comprise a plurality of first flip plates and a plurality of second flip plates, the first flip plates and the second flip plates are located on a bottom side of the housing and have different heights relative to the bottom plate after rotation.

13. The housing positioning structure according to claim 12, wherein the first flip plate comprises a first fixed edge and a first folding edge, the first fixed edge is connected to a wall of the housing, and the first folding edge is rotatable outwardly in a direction away from the accommodation space.

14. The housing positioning structure according to claim 13, wherein a plurality of first bending holes is defined on the first fixed edge and are located on one side connected to the wall of the housing.

15. The housing positioning structure according to claim 1, wherein the lower supporting structure comprises a bending arm and a clamping piece, and the bending arm is foldable outwardly in a direction away from the accommodation space.

16. The housing positioning structure according to claim 15, wherein the clamping piece is in an L shape and comprises a second bending section and a third bending section, the second bending section is connected to the bending arm, and the third bending section is bent and extends from the second bending section in a direction away from the accommodation space.

17. The housing positioning structure according to claim 16, wherein a fixing hole is defined on the third bending section.

18. The housing positioning structure according to claim 16, wherein a plurality of bending slots is defined at a connection portion between the second bending section and the third bending section.

* * * * *